US009139336B2

(12) United States Patent
Jego

(10) Patent No.: US 9,139,336 B2
(45) Date of Patent: Sep. 22, 2015

(54) BLANK AND PACKAGING FOR A CARTON PACK WITH AN INTEGRATED SPACING/WEDGING PART

(71) Applicant: AUTOMATISATION ET RENOVATION DU CONDITIONNEMENT DANS LES INDUSTRIES LAITIERES ARCIL, PUISEUX PONTOISE (FR)

(72) Inventor: Fabien Jego, Saint Andre les Verges (FR)

(73) Assignee: AUTOMATISATION ET RENOVATION DU CONDITIONNEMENT DANS LES INDUSTRIES LAITIERES ARCIL, PUISEUX PONTOISE (FR)

( * ) Notice: Subject to any disclaimer, the term of this patent is extended or adjusted under 35 U.S.C. 154(b) by 332 days.

(21) Appl. No.: 13/904,332

(22) Filed: May 29, 2013

(65) Prior Publication Data

US 2014/0305938 A1 Oct. 16, 2014

(30) Foreign Application Priority Data

Apr. 16, 2013 (FR) ..... 13 53456

(51) Int. Cl.

| | |
|---|---|
| ***B65D 71/00*** | (2006.01) |
| ***B65D 21/02*** | (2006.01) |
| ***B65D 75/20*** | (2006.01) |
| ***B65B 5/02*** | (2006.01) |
| ***B65B 5/06*** | (2006.01) |
| ***B65D 71/16*** | (2006.01) |

(52) U.S. Cl.

CPC ..... *B65D 21/0201* (2013.01); *B65B 5/024* (2013.01); *B65B 5/06* (2013.01); *B65D 71/16* (2013.01); *B65D 75/20* (2013.01); *B65D 2571/0066* (2013.01); *B65D 2571/00141* (2013.01); *B65D 2571/00277* (2013.01); *B65D 2571/00302* (2013.01); *B65D 2571/00716* (2013.01)

(58) Field of Classification Search

CPC combination set(s) only.
See application file for complete search history.

(56) References Cited

U.S. PATENT DOCUMENTS 4,489,880 A 12/1984 Calvert
4,671,453 A * 6/1987 Cassidy ..... 206/485.1

(Continued)

FOREIGN PATENT DOCUMENTS

EP 99 755 2/1984
EP 277 030 8/1988

(Continued)

*Primary Examiner* — Jacob K Ackun
(74) *Attorney, Agent, or Firm* — Young & Thompson

(57) ABSTRACT

A blank includes: two top panels, two side panels, two connecting panels, a base panel, a connecting element for the closing on itself of the blank that is expanded in volume; a receiving part, extending over a part of the base panel, for receiving wedging cartons by their bottom walls, and if necessary extending over the connecting panels; and a spacing/wedging part, coming from the base panel with cutout lines. The continuous spacing/wedging part is formed by a longitudinally median transverse portion of the base panel and a longitudinally median transverse portion, in two sections, of the two connecting panels, one section per connecting panel. The spacing/wedging part is limited in the transverse direction by two continuous and curved edge cutout lines of the spacing/wedging part, advancing overall in the longitudinal direction, whose segments form stopping edges.

27 Claims, 8 Drawing Sheets

(56) References Cited

U.S. PATENT DOCUMENTS

| | | | | |
|---|---|---|---|---|
| 4,703,847 | A | 11/1987 | Oliff | |
| 4,703,856 | A * | 11/1987 | Chaussadas | 206/429 |
| 5,031,770 | A * | 7/1991 | Chaussadas | 206/434 |
| 5,439,112 | A | 8/1995 | De Guglielmo et al. | |
| 5,638,956 | A * | 6/1997 | Sutherland | 206/434 |
| 6,942,140 | B2 * | 9/2005 | Merzeau | 229/117.22 |
| 8,061,519 | B2 * | 11/2011 | Taglione | 206/430 |

FOREIGN PATENT DOCUMENTS

| | | |
|---|---|---|
| EP | 461 947 | 12/1991 |
| EP | 0 615 920 | 9/1994 |
| EP | 668 835 | 2/1998 |

* cited by examiner

BLANK AND PACKAGING FOR A CARTON PACK WITH AN INTEGRATED SPACING/WEDGING PART

The invention relates to the field of packaging for packs comprising several cartons that are grouped beside one another, using a tubular-envelope-type cardboard packaging that encompasses the group of cartons, produced by expanding a flat cardboard blank in volume and closing it on itself.

More specifically, the invention has as its object a flat cardboard blank that is designed for the formation of a final packaging for a pack that includes at least one base carton layer comprising four cartons that are two by two, side by side, and opposite one another, positively spaced and wedged on their side walls in the vicinity of their bottom walls, a process for the production of such a pack, an intermediate packaging carried out in an intermediate stage of the process, with the final packaging produced in the final stage of the process, the pack produced, and, finally, a production line for such a pack.

A carton, such as the one of the pack being considered, comprises a bottom wall, a side wall that is closed on itself, and a top closure. In a simple embodiment, the carton is in the shape of a cylinder or a truncated cone and comprises a transverse collar toward its upper opening, the top closure being a flat lid that is connected with and on the collar. In other embodiments, the generatrix of the side wall is a line other than a straight line, having a more or less complex shape, and the directing curve is other than a circle, being, for example, a curvilinear square with rounded corners. Such a carton can remain straight by resting on its bottom wall forming a seat. In other embodiments, the side wall is rounded to reach the bottom wall.

In one embodiment, such a carton is made of heat-formed plastic, and it has a certain stability that allows it to be self-supporting, but the carton can be made of other materials and by other processes.

Such a carton is typically designed to contain contents that may or may not be homogeneous, having an overall state that is more or less fluid and that does not exclude the presence of more or less solid pieces. Such contents are, for example, a milky product or a dessert, with this list not being limiting.

In one embodiment, the carton is designed to accommodate an amount of such contents for individual and joint use, for example on the order of one hundred grams, and, in this case, it may have a height on the order of several centimeters and come laterally into a cylinder whose diameter is also on the order of several centimeters. In other embodiments, the carton, designed for a mini-amount, is smaller, or, in contrast, designed for a larger amount, is larger.

As appropriate, the cartons are individualized or else they are connected to one another, for example by their collars, in such a way as to form a pallet of cartons.

In one possible elementary embodiment, the pack comprises a single base carton layer of four cartons, two by two, side by side, and opposite one another, in a square. In other embodiments, the pack comprises several (two, three . . . ) layers of superposed cartons—including the base layer and a top layer. In other embodiments, a layer comprises more than four cartons, in particular arranged in three—or more—longitudinal rows and two transverse rows.

In a known way, in particular from the document EP 0 615 920, a cardboard packaging, in the shape of a tubular envelope, for such a pack of cartons is made from a flat cardboard blank, in a general rectangular shape, limited by two free edges in the longitudinal direction and two free edges in the transverse direction.

Such a known blank comprises:

Arranged one behind another in the longitudinal direction, a first top panel, a first side panel, a first connecting panel, a base panel, a second connecting panel, a second side panel, a second top panel, with the first top panel and the second top panel being arranged in such a way as to be capable of being arranged and designed to be arranged in a coplanar way and connected to one another for the closing on itself of the blank that is expanded in volume, the formation of a top wall of the packaging, and the composition of the packaging and the pack, Grooved lines in the transverse direction, capable of and designed for the folding of panels, for expanding the blank in volume and for the composition of the packaging, including two base grooved lines, between the base panel and the two connecting panels, and two intermediate grooved lines, between the two connecting panels and the two side panels, Cutout lines, A solid receiving part, extending in a substantial way over the base panel, capable of receiving and designed to receive cartons by their bottom walls.

So that in the pack produced, the cartons cannot move or can move only a little at an inopportune moment or strike one another, it is provided that the cardboard blank also comprises a spacing/wedging part, capable of and designed for spacing and wedging, once the packaging and the pack are put together, cartons for wedging relative to one another in the vicinity of their bottom walls.

In the embodiment described in the document EP 0 615 920, this spacing/wedging part comes from the base panel, with grooved lines and cutout lines. It is designed to be expanded in volume relative to the receiving part. Thus, stopping edges are put together on their side walls, in the vicinity of their bottom walls. More specifically, and for four wedging cartons, two by two and opposite one another in a square, there is provided a spacing/wedging part in two sub-parts, each one for two wedging cartons. Each spacing/wedging sub-part comprises a support foot, cut into the base panel, articulated with the base panel by a grooved pivoting line and comprising, opposite, a grooved pivoting line with a wedging wall. This wedging wall is itself also cut into the base panel, and it is articulated with the support foot as indicated.

With such an arrangement, each wedging wall comprises a free edge that is cut out opposite the support foot, in such a way that it is held only by a single side, by the support foot, and with the other side, with the free edge, not being held. There is a risk that the wedging wall will lose its position that is specific to wedging. In addition, the installation of the spacing/wedging part requires stressing the two spacing/wedging sub-parts.

The document EP 461 947 describes a packaging device for a group of objects that are essentially identical and that are arranged over several rows, comprising an upper part, a bottom on which a beam is set up that separates the objects and that has a frontal surface parallel to the bottom and two cheeks that are perpendicular to the bottom with pairs of tabs interconnecting the edges of the cheeks opposite to the frontal surface, and two side surfaces connecting the upper part and the bottom to form a tubular structure.

The state of the art is also illustrated by the documents EP 99 755, EP 668 835, and EP 277 030.

Starting from the production of a flat cardboard blank, known for the indicated purpose, which has a general rectangular shape and makes it possible to form a final packaging for a pack, of the tubular envelope type, the pack including at least one base carton layer for wedging that comprises four wedging cartons two by two, side by side and opposite one another, positively spaced and wedged on their side walls in the vicinity of their bottom walls, with the blank comprising two top panels, two side panels, two connecting panels, a base panel, a means of connection for the closing on itself of the blank that is expanded in volume; cutout lines, and grooved lines in the transverse direction, capable of and designed for the folding of panels, for expanding the blank in volume, and for putting together the packaging and the pack; a receiving part that extends over a part of the base panel, for receiving wedging cartons that are positively spaced and wedged by their bottom walls and extending, if necessary, over the connecting panels; and a spacing/wedging part of the positively spaced and wedged wedging cartons, coming from the base panel with cutout lines, able to be expanded in volume relative to the receiving part, in such a way as to put together stopping edges of the wedging cartons, thus positively spaced and wedged on their side walls in the vicinity of their bottom walls, the problem on which the invention is based is to provide a spacing/wedging part that, once expanded in volume and in position, cannot change shape, collapse, or fail for the positively spaced and wedged wedging cartons. This problem is posed in combination with the one of a high machinability for high speeds, with a reliable process and a production line that avoids detrimental complexities.

Below, a disclosure of the invention as it is characterized:

According to a first aspect, the invention has as its object a flat cardboard blank, of a general rectangular shape, designed for the formation of a final packaging for a pack of cartons, of the tubular envelope type, with the pack including at least one base carton layer for wedging, comprising four wedging cartons that are two by two, side by side, and opposite one another, positively spaced and wedged on their side walls in the vicinity of their bottom walls, comprising:

Two top panels, two side panels, two connecting panels, a base panel, a connecting means for the closing on itself of the blank that is expanded in volume, Cutout lines, and grooved lines in the transverse direction, capable of folding and designed to fold panels, of expanding the blank in volume, and of putting together the packaging and the pack, A part for receiving wedging cartons, extending over a part of the base panel, for receiving wedging cartons by their bottom walls, and if necessary extending over the connecting panels, And a spacing/wedging part of the wedging cartons, coming from the base panel with cutout lines, able to be expanded in volume relative to the receiving part, in such a way as to put together stopping edges of the wedging cartons in the vicinity of their bottom walls.

This blank is such that:

The continuous spacing/wedging part is formed by a longitudinally median transverse portion of the base panel and a longitudinally median transverse portion, in two sections, of the two connecting panels, one section per connecting panel, A continuity approach exists between, on the one hand, the spacing/wedging part, and, on the other hand, the receiving part and the portions of connecting panels other than the one of the spacing/wedging part, The segments of grooved lines of the spacing/wedging part form two irreversible-pivot double hinges, such that the longitudinally median transverse portion of the base panel can be separated from the receiving part along an axis that is perpendicular or essentially perpendicular to the receiving part, The spacing/wedging part is limited in the transverse direction by two continuous and curved edge cutout lines of the spacing/wedging part, advancing overall in the longitudinal direction, whose segments form stopping edges of the wedging cartons on their side walls in the vicinity of their bottom walls.

According to one embodiment, the blank comprises:

Two free edges in the longitudinal direction and two free edges in the transverse direction, Arranged one behind another in the longitudinal direction, a first top panel, a first side panel, a first connecting panel, a base panel, a second connecting panel, a second side panel, and a second top panel, with a means for connecting two top panels to one another for the closing on itself of the blank expanded in volume with formation of a top wall, Two base grooved lines, between the base panel and the two connecting panels, two intermediate grooved lines, between the two connecting panels and the two side panels, and two grooved top lines, between the two top panels and the two adjacent side panels, The spacing/wedging part, limited in the longitudinal direction by, and extending between, two intermediate median grooved segments on either side of two base median grooved segments, with, for each intermediate grooved line, a continuity approach between its median segment and its two end segments and, for each base grooved line, a continuity approach between its median segment and its two end segments, with the intermediate median grooved segment and the base median grooved segment of a connecting panel delimiting a section of the longitudinally median transverse portion of the connecting panel and forming one of the irreversible-pivot double hinges of this section of the longitudinally median transverse portion of the connecting panel relative to the longitudinally median transverse portion of the base panel and the side walls, For the base panel, a continuity approach between its longitudinally median transverse portion and its two end portions, and, for the two connecting panels, a continuity approach between the longitudinally median transverse portion and the two end portions.

According to one embodiment, each edge cutout line of the spacing/wedging part comprises two cutout lateral segments and, between them, a cutout median segment, and:

A cutout lateral segment has a side end on the intermediate grooved line and a median end toward the transverse median axis of the base panel, extends with a convexity rotated toward the spacing/wedging part, and is capable of and designed for being part of a stopping edge, A cutout median segment extends in the longitudinal direction.

For example, at its side end, the cutout lateral segment is at least essentially tangent to the intermediate grooved line; the cutout lateral segment has a general shape that is close or similar to the one of a circular arc whose angle in the center is on the order of 180°; the length of the cutout median segment corresponds, with the packaging and the pack put together, to the spacing between two positively spaced and wedged wedging cartons, adjacent in the longitudinal direction, in the longitudinally median transverse portion of the base panel; the cutout lateral segment extends over the adjacent connecting panel and toward the adjacent end portion of this connecting panel by a cutout lateral extension, extending up to a side terminal end, over the adjacent base grooved line, in particular with a general shape that is close or similar to that of a circular arc whose angle in the center is on the order of 90°;

the smallest separation between two opposite cutout lateral segments corresponds, with the packaging and the pack put together, to the separation between two positively spaced and wedged wedging cartons that are adjacent in the transverse direction.

According to one embodiment, the intermediate median grooved segments and the base median grooved segments are grooved and provided with intermittent cut-outs.

According to one embodiment, the receiving part is made of two separate receiving portions, located on either side, transversely, of the longitudinally median transverse portion of the base panel of the spacing/wedging part.

According to a first possible embodiment, such a receiving portion is limited opposite the spacing/wedging part, directly via a longitudinal free edge. The blank is then especially suitable for and designed for a pack whose base carton layer consists of four positively spaced and wedged wedging cartons.

According to a second possible embodiment, the blank is such that, in the transverse direction, it comprises, toward one and/or the other of its free longitudinal edges, an extension of the top panels, side panels, connecting panels, and the base panel, and in which one and/or the other of a receiving portion is limited opposite the spacing/wedging part, indirectly by a longitudinal free edge, by means of the presence between them of the extension of the base panel, for receiving additional—base—layer cartons. The blank is then especially suitable for and designed for a pack whose—base—carton layer comprises the four positively spaced and wedged wedging cartons, and from the side with an extension or from each of the two sides with extensions, at least two additional layer cartons, arranged by extending four positively spaced and wedged wedging cartons.

According to one embodiment, a receiving portion of the receiving part is limited to the spacing/wedging part by an edge cutout line of the receiving portion that is continuous, curved and that advances in the longitudinal direction, in such a way as to reach the two base grooved lines.

According to one embodiment, an edge cutout line of the receiving portion:

- Has a side terminal end on a base grooved line, essentially common with the side terminal end of the adjacent cutout lateral extension,
- Is arranged opposite and separated by an empty space, of the adjacent cutout lateral extension and a first length of the cutout lateral segment that is adjacent to its side end, with the empty space being capable of and designed to work with the side wall of a positively spaced and wedged wedging carton,
- And is either common with a second cutout lateral segment, which segment consists of the first length and the second length end-to-end, and with the cutout median segment, or arranged opposite and separated by an empty space, of this second length and this cutout median segment.

For example, an edge cutout line segment, for the receiving sub-portion of a wedging carton, comprises a general shape that is close or similar to that of a circular arc whose angle in the center is on the order of 180° to 270°.

According to one embodiment, the longitudinally median transverse portion of the base panel and the sections of the longitudinally median transverse portion of the connecting panels of the spacing/wedging part together have a cross shape with four large branches joined by curved edges.

According to one embodiment, the stopping edges comprise, except for cutout median segments, all or part of the edge cutout lines of the spacing/wedging part and their lateral extensions, in particular substantially comprise all of the edge cutout lines and their lateral extensions, more particularly are formed by, in particular substantially consist of, the cutout lateral segments and the cutout lateral extensions.

According to one embodiment, each stopping edge of a wedging carton has a general shape that is close or similar to that of a circular arc whose angle in the center is on the order of 270°.

According to one embodiment, the longitudinally median transverse portion of the base panel of the spacing/wedging part extends transversely over, on the order of one-half of, the transverse dimension of the base panel, for a pack whose base carton layer consists of four positively spaced and wedged wedging cartons, or, respectively, on the order of one-third, for a pack of which the base carton layer consists of at least six cartons including the four positively spaced and wedged wedging cartons, and two additional layer cartons.

According to one embodiment, each top grooved line comprises segments cut out from top grooved lines, each capable of working and designed to work with the edge of the top closure of a carton of the top carton layer.

According to one embodiment, the longitudinal dimension of a connecting panel—the separation between the intermediate grooved line and the base grooved line of this connecting panel—is between on the order of 30% to 50%, more particularly on the order of 40%, of the longitudinal dimension of a side panel—the separation between the intermediate grooved line and the top grooved line of this side panel—for a pack that has a single carton layer—the base layer—or, respectively, on the order of 15% to 25%, more particularly on the order of 20%, for a pack that has two layers of cartons—the base layer and a top layer.

According to one embodiment, the longitudinal dimension of the unit formed by the base panel and the two connecting panels—the separation between the two intermediate grooved lines—is essentially equal to the longitudinal dimension of the top wall of the packaging, and in particular is essentially equal to the dimension of the first top panel—the separation between the transverse free edge and the top grooved line of the first top panel.

According to one embodiment, the second top panel is a narrow flap provided with glue.

According to the embodiments, in the longitudinal direction, each side panel is made of a single portion or is made of several portions that are separated by folding lines or zones, with the blank being suitable and designed for a pack that has a single layer of cartons—the base layer—or that has several layers of cartons—including the base layer and a top layer—in particular one side panel portion per layer of cartons.

According to a second aspect, the invention has as its object a process for the production of a pack of cartons including at least one base carton layer comprising four wedging cartons, two by two, side by side and opposite one another, positively spaced and wedged on their side walls in the vicinity of their bottom walls, each carton being of the type that has a bottom wall, a side wall closed on itself, and a top closure, packaged in a packaging produced from a flat blank, expanded in volume and closed on itself, in which:

- A flat cardboard blank, as described above, is available,
- The four wedging cartons, designed to be part of the pack, are available,
- The four wedging cartons are arranged in a base carton layer on the receiving part of the blank—arranged horizontally overall—in such a way that the wedging cartons are arranged two by two, side by side and opposite one another, Then, the blank is expanded in volume, around cartons, by folding connecting panels around the two base grooved lines, side panels around two intermediate grooved lines, and top panels around the two top grooved lines, Then, in an intermediate stage, the two top panels are arranged in a coplanar way, and they are connected to one another in such a way as to close on itself the blank that is expanded in volume, to form the top wall, and to put together an intermediate packaging surrounding the cartons, in which the receiving part and the longitudinally median transverse portion of the base panel of the spacing/wedging part are essentially coplanar, Then, in a final stage, the spacing/wedging part is stressed in a relative way in relation to the rest of the intermediate packaging and the cartons, in such a way that:

The longitudinally median transverse portion of the base panel of the spacing/wedging part is separated in a relative way from the receiving part and in a relative way is moved toward the top wall, along the axis of elevation of the packaging, whereas the two sections of the longitudinally median transverse portion of the two connecting panels are pivoted around irreversible-pivot double hinges in a relative way in relation to the end portions of the two connecting panels that are stationary, The stopping edges are moved toward the side walls of the wedging cartons in such a way as to be positioned in an adjacent way to their side walls, in the vicinity of their bottom walls, And the final packaging of the pack as well as the pack are thus put together.

According to one embodiment, for stressing the spacing/wedging part, the longitudinally median transverse portion of the base panel is stressed directly and in particular at least toward the base median grooved segments.

According to one embodiment, for stressing the spacing/wedging part, only the longitudinally median transverse portion of the base panel is stressed directly, without directly stressing the longitudinally median transverse portion of the connecting panels.

According to one embodiment, a section of the longitudinally median transverse portion of a connecting panel pivots around the intermediate median grooved segment by an angle on the order of 90°.

According to one embodiment, a section of the longitudinally median transverse portion of a connecting panel pivots around the intermediate median grooved segment by passing beyond a stressed intermediate position where it is located in the plane that is defined by the two intermediate grooved lines.

According to the desired configurations, the process is such that a blank is arranged according to the first embodiment described above, and the four wedging cartons are arranged in a base carton layer that consists of these four wedging cartons, or a blank is arranged according to the above-described second embodiment, and the four wedging cartons are arranged in a base carton layer comprising these four wedging cartons, and from the side with an extension or from each of the two sides with extensions of the blank, at least two additional layer cartons, arranged in extension of the four wedging cartons.

According to a third aspect, the invention has as its object an intermediate packaging, carried out in the intermediate stage of the process as was just described, such that:

The base panel is arranged in a plane, with the receiving part and the longitudinally median transverse portion of the base panel being essentially coplanar, The longitudinally median transverse portion and the end portions of a connecting panel are essentially coplanar, and the connecting panels are set up relative to the plane of the base panel and form an oblique angle $\alpha$ with it, The side panels extend beyond the connecting panels up to the top wall and form an oblique angle $\beta$, close to the angle $\alpha$, with the connecting panels.

According to one embodiment, the oblique angles $\alpha$ and $\beta$ are on the order of 135°.

According to the desired configurations, the intermediate packaging is carried out from a blank according to the first embodiment described above, or from a blank according to the second embodiment described above.

According to a fourth aspect, the invention has as its object a final packaging, produced in the final stage of the process as it was described above, such that:

The receiving part and the longitudinally median transverse portion of the base panel of the spacing/wedging part are essentially parallel to one another and separated from one another, along the axis of elevation of the packaging, and the longitudinally median transverse portion of the base panel is arranged between the plane of the receiving part and the plane of the top wall, The end portions of the connecting panels are set up relative to the receiving part and form an oblique angle $\alpha$ with it, The section of the longitudinally median transverse portion and the end portions of each of the connecting panels form an angle $\gamma$ with one another, The section of the longitudinally median transverse portion of each of the connecting panels forms an acute angle $\theta$ with the adjacent side panel, The side panels extend beyond the end portions of the connecting panels up to the top wall and form an oblique angle $\beta$, close to the angle $\alpha$, with the end portions of the connecting panels, The stopping edges, one per wedging carton, comprise, except for cutout median segments, all or part of the edge cutout lines of the spacing/wedging part and their lateral extensions, in particular substantially comprise all of the edge cutout lines and their lateral extensions, more particularly are formed by—in particular substantially consist of—the cutout lateral segments and the cutout lateral extensions.

According to one embodiment, the angle $\alpha$ and the angle $\beta$ are close and on the order of 135°, and the angle $\gamma$ is on the order of a right angle.

According to the embodiments, the longitudinally median transverse portion of the base panel of the spacing/wedging part is spaced from the receiving part on the order of one-third the distance between the longitudinally median transverse portion of the base panel of the spacing/wedging part and the top wall for a pack that has a single base carton layer, or respectively, on the order of one-fourth for a pack that has two carton layers, including the base layer and a top layer.

According to the embodiments, each side panel is made of a single portion or is made of several portions separated by folding lines or zones, with the final packaging being adapted for and designed for a pack that has a single base carton layer or that has several carton layers—including the base layer and a top layer—in particular one side panel portion per carton layer.

According to the desired configurations, the final packaging comprises a blank according to the first embodiment described above, with the final packaging then being especially suitable for and designed for a pack whose base carton layer consists of four wedging cartons, or else the final packaging comprises a blank according to the second embodiment that is described above, with the final packaging then being especially suitable for and designed for a pack whose base carton layer comprises the four wedging cartons and, from the side with an extension or from each of the two sides with extensions, at least two additional layer cartons, arranged in extension of the four wedging cartons.

According to a fifth aspect, the invention has as its object a pack of cartons including at least one base carton layer comprising four wedging cartons, two by two, side by side, and opposite one another, positively spaced and wedged on their side walls in the vicinity of their bottom walls, of the type having a bottom wall, a side wall closed on itself, and a top closure, and a final packaging as was just described in which:

The wedging cartons are received by their bottom walls on the receiving part,

The top wall is applied on or adjacent to the closure of cartons of the upper layer of the pack, The stopping edges of the packaging are placed in a way that is adjacent to the side wall of the wedging cartons, positively spaced and wedged in the vicinity of their bottom walls, in such a way as to ensure the spacing and the wedging of wedging cartons in the vicinity of their bottom walls.

According to the embodiments, the cartons of the pack may or may not comprise a collar toward the opening and may or may not be connected to one another by their collars.

According to one embodiment, in which the pack cartons comprise a collar, the collars of the cartons of the top carton layer work with the cutout segments of the top grooved lines.

According to one embodiment, portions of the side walls of the positively spaced and wedged wedging cartons of the base carton layer are placed in empty spaces between the receiving part and the spacing/wedging part, extending along the axis of elevation of the packaging.

According to the embodiments, the pack comprises a final packaging such that the base carton layer consists of four positively spaced and wedged wedging cartons, or else a final packaging such that the base carton layer comprises the four positively spaced and wedged wedging cartons, and from the side with an extension or from each of the two sides with extensions, at least two additional layer cartons, arranged in an extension of the four wedging cartons.

According to a sixth and final aspect, the invention has as its object a production line of a pack as it was just described, which comprises:

Means for supplying flat cardboard blanks, as described above,

Means for supplying cartons, designed to be part of the pack,

Combined with means for supplying flat cardboard blanks and with means for an overall supply of cartons, conveying means, arranged horizontally overall, capable of conveying and designed to convey flat blanks, blanks with cartons resting above, intermediate packaging, final packaging, with, longitudinally, functional means comprising from upstream to downstream:

Means for gripping, moving and arranging cartons, capable of arranging and designed to arrange the four wedging cartons in a base layer, on the receiving part of the blanks on the conveying means, Means for folding, capable of expanding in volume and designed to expand in volume the blanks around cartons by folding connecting panels around base grooved lines, side panels around intermediate grooved lines, and top panels around top grooved lines, Means for closing and for connecting, capable of arranging and designed to arrange in a coplanar way and to connect the two top panels to one another, and to put together an intermediate packaging that surrounds the cartons, Stressing means, capable of stressing and designed to stress the spacing/wedging part of cartons in a relative way in relation to the rest of the intermediate packaging and to the four wedging cartons, suitable for acting according to in [sic] a direction that is perpendicular or essentially perpendicular to the plane of movement of the conveying means, which is also the axis of elevation of the packaging, in such a way as to put together the final packaging of the pack, and the pack, And means for removing the packs.

According to one embodiment, the means for gripping, moving and arranging cartons are not only capable of arranging and not only designed to arrange the four wedging cartons of a base carton layer, on the receiving part of the blanks on the conveying means, but also of arranging and to arrange additional layer cartons for a top layer and/or additional layer cartons. It is thus possible to produce packs that also comprise additional layer cartons, including a top layer, and/or additional layer cartons (with one or more layers).

According to one embodiment, the stressing means comprise:

Holding means that are capable of holding and designed to hold the intermediate packaging part other than the spacing/wedging part, And means for movement in the direction that is perpendicular or essentially perpendicular to the plane of movement of the conveying means, which is also the axis of elevation of the packaging, capable of acting and designed to act on the spacing/wedging part, in the direction of the flat spacing of movement of the conveying means.

According to one embodiment, the holding means, which are capable of holding and designed to hold the intermediate packaging part other than the spacing/wedging part of cartons, comprise holding belts, suction pads, guides, stops, and robots.

According to one embodiment, the means for movement in the direction that is perpendicular or essentially perpendicular to the plane of movement of the conveying means comprise cylinders, movable plates, cams, suction pads, guides, and robots.

Relative to the state of the prior art, the advantages of the invention are that the spacing/wedging part, once expanded in volume and in position, cannot change shape, collapse, or fail for the wedging cartons, this being achieved by means of a high machinability for high speeds, in a reliable way with a production line that prevents detrimental complexities.

The figures of the drawings will now be briefly described.

In these figures, the parts in dotted lines, which are solid cardboard parts, show the presence of empty spaces.

Figure 1A:
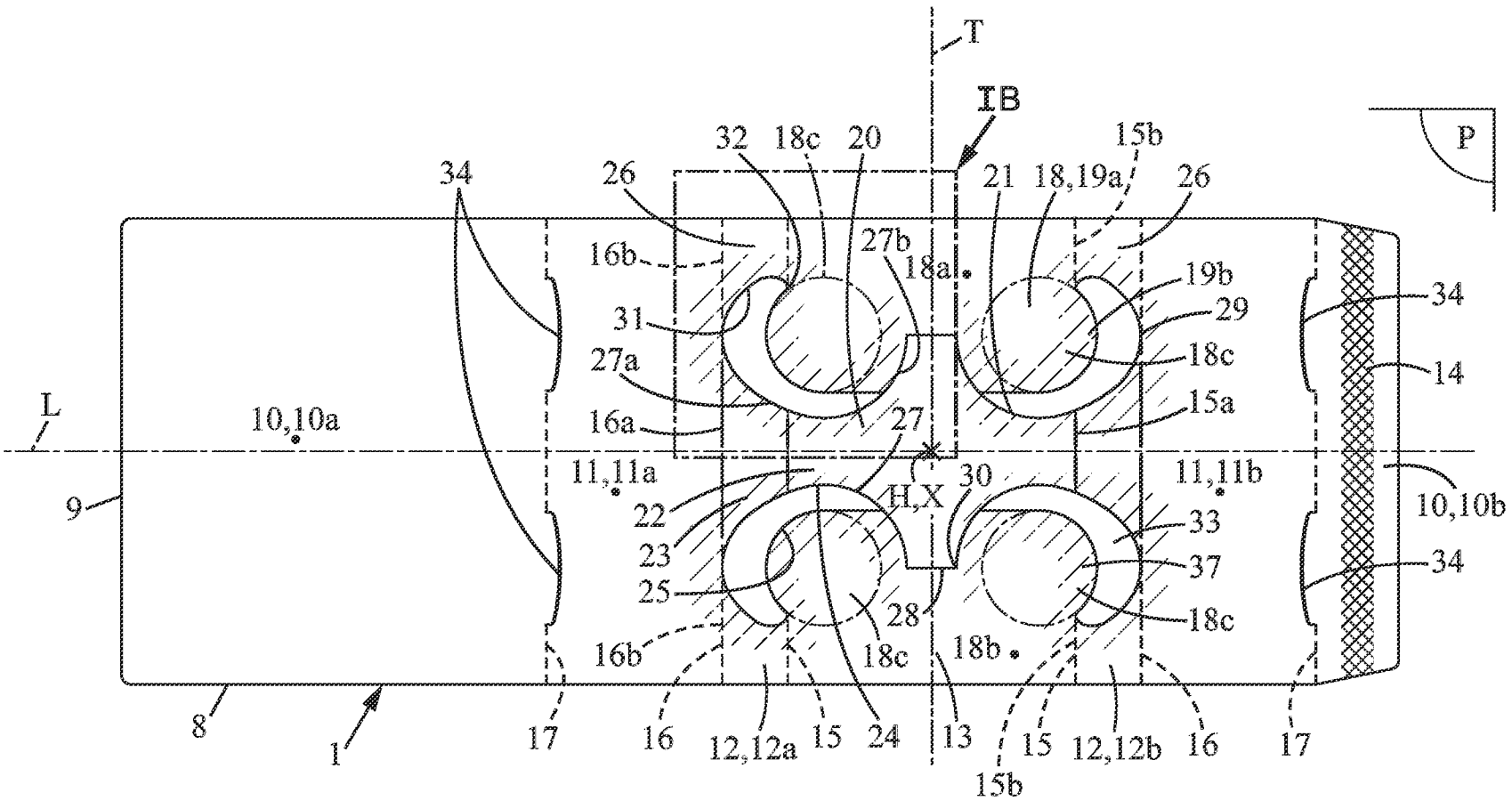
FIG. 1A is a view, in elevation, of a possible blank embodiment according to the invention, shown flat, designed for the production of a pack that has a single base carton layer of four wedging cartons, two by two and opposite one another, designed to be positively spaced and wedged on their side walls in the vicinity of their bottom walls, in accordance with the invention.
Figure 1B:
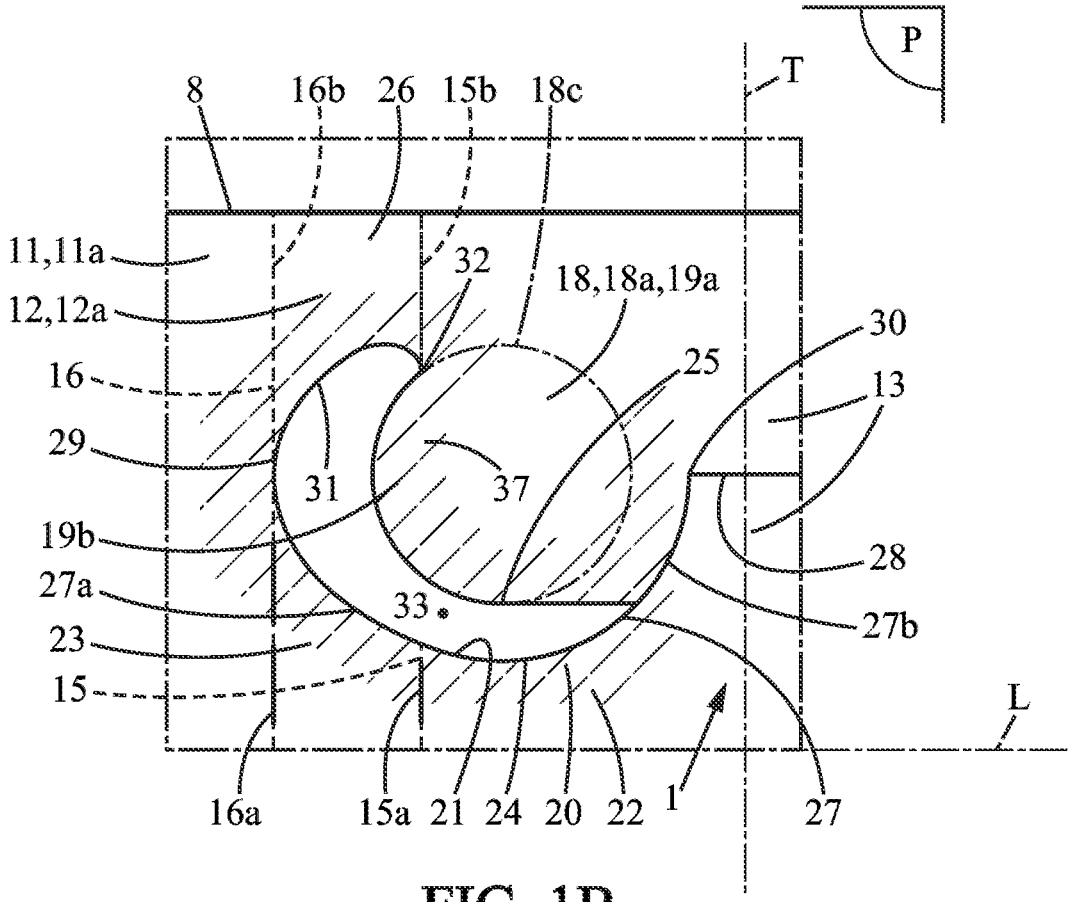
FIG. 1B is a partial enlargement and on a larger scale of FIG. 1A.
Figure 2:
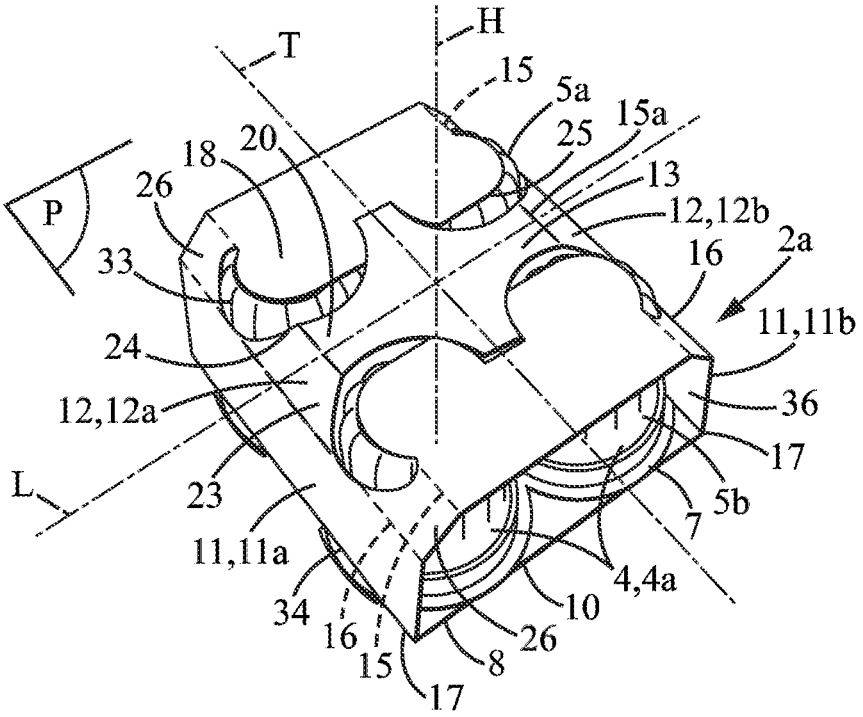

FIG. 2 is a perspective view, from below, of the so-called "intermediate" packaging for a pack with a single base carton layer of four wedging cartons, made from a blank such as the one of FIGS. 1A and 1B, in the intermediate stage of the process for production of the pack, according to the invention, illustrating, quite especially, that the base panel is arranged in a plane, because the receiving part and the longitudinally median transverse portion of the base panel are essentially coplanar, and that the longitudinally median transverse portion and the end portions of the connecting panels are also essentially coplanar, whereas the connecting panels project, relative to the base panel plane, by being inclined relative to it with an oblique angle, and that the side panels extend beyond the connecting panels up to the top wall and form an oblique angle with the connecting panels.

Figure 3:
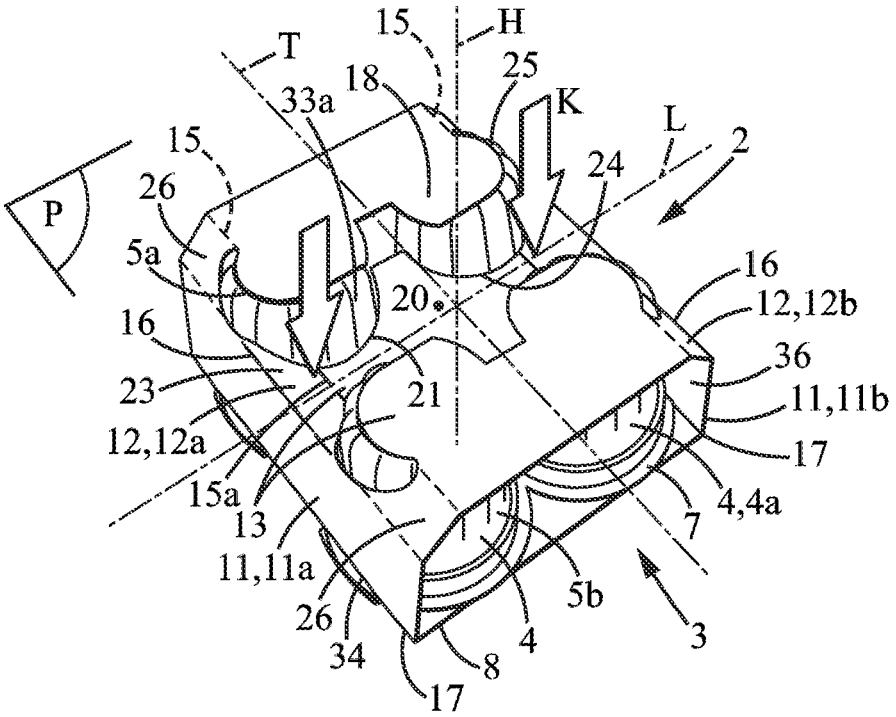

FIG. 3 is a perspective view, from below, analogous to FIG. 2, in the final stage of the process for the production of the pack, illustrating, quite especially, that the receiving part and the longitudinally median transverse portion of the base panel of the spacing/wedging part are separated from one another, along the axis of elevation of the packaging, with the longitudinally median transverse portion of the base panel being arranged between the plane of the receiving part and the plane of the top wall, that the end portions of the connecting panels project relative to the receiving part and form an oblique angle with it, that the section of the longitudinally median transverse portion [sic], that the end portions of each of the connecting panels are inclined relative to one another, that the section of the longitudinally median transverse portion of the connecting panels forms an acute angle with the adjacent side panel, that the side panels extend beyond the end portions of the connecting panels up to the top wall and form an oblique angle with the end portions of the connecting panels and also illustrate the stopping edges and the stressing of the spacing/wedging part to move it along the axis of elevation of the packaging.

Figure 4:
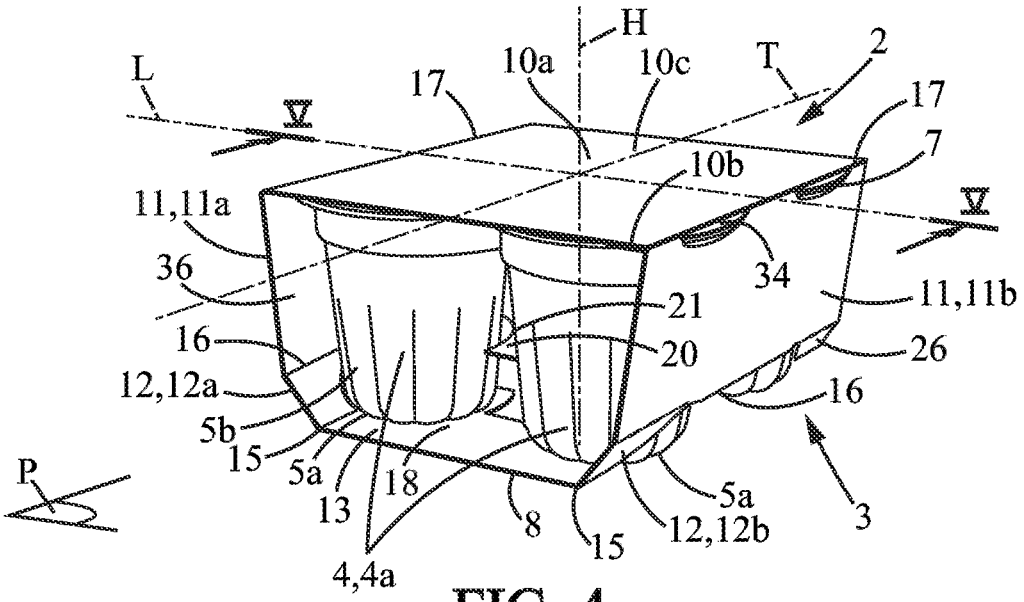

FIG. 4 is a perspective view, from the top, of the pack of FIG. 3, including the so-called "final" packaging, illustrating, quite especially, that the positively spaced and wedged wedging cartons are received by their bottom walls on the receiving part, that the top wall is adjacent to the closure of cartons of the top layer of the pack, and that the stopping edges are placed in an adjacent way to the side wall of the wedging cartons, which are positively spaced and wedged in the vicinity of their bottom walls.

Figure 5:
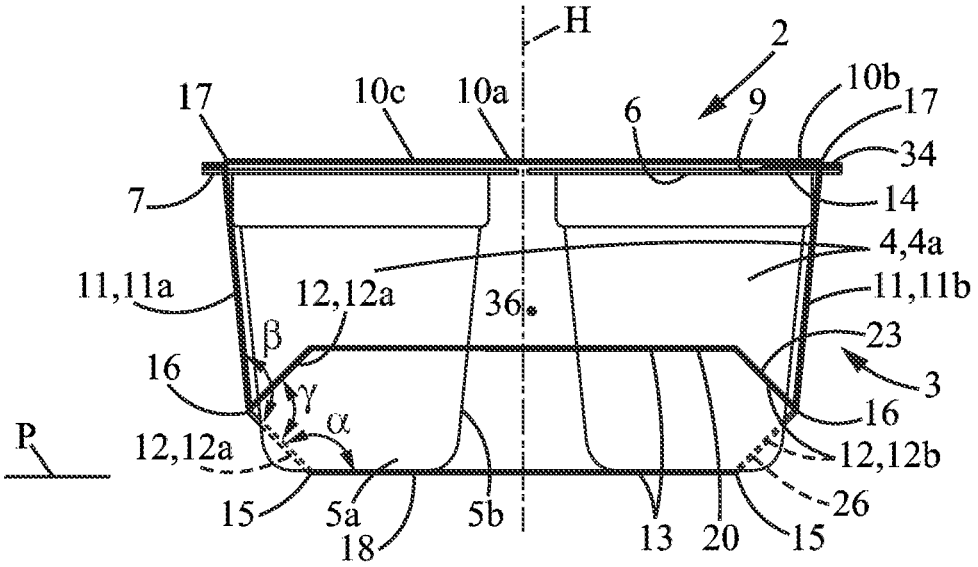

FIG. 5 is a view, in cutaway, along the line Iv-Iv of FIG. 3, via a longitudinal plane that passes through the axis of elevation of the packaging and of the pack and is located between the two pairs of positively spaced and wedged wedging cartons, separated transversely and facing the wedging spacing part, illustrating, quite especially, that the receiving part and the longitudinally median transverse portion of the base panel of the spacing/wedging part are separated from one another, along the axis of elevation of the packaging, with the longitudinally median transverse portion of the base panel being arranged between the plane of the receiving part and the plane of the top wall, that the end portions of the connecting panels are set up relative to the receiving part and form an oblique angle with it, that the section of the longitudinally median transverse portion, and the end portions of each of the connecting panels are inclined relative to one another by approximately 90°, that the section of the longitudinally median transverse portion of the connecting panels forms an acute angle with the adjacent side panel, that the side panels extend beyond the end portions of the connecting panels up to the top wall and form an oblique angle with the end portions of the connecting panels.

Figure 6A:
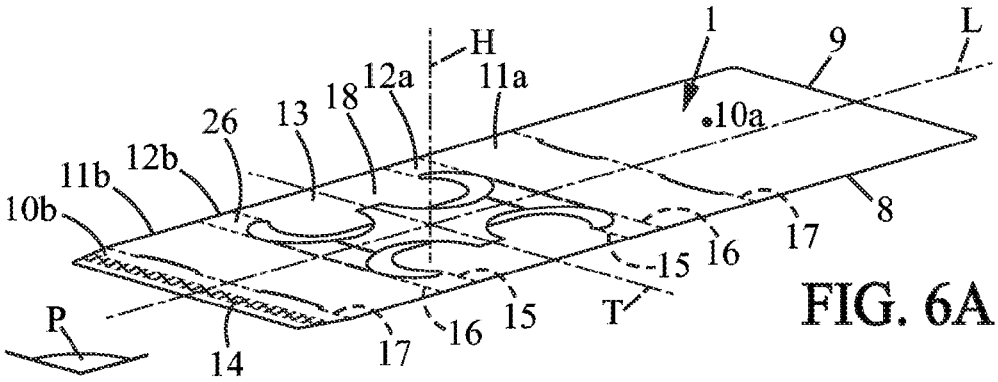
Figure 6B:
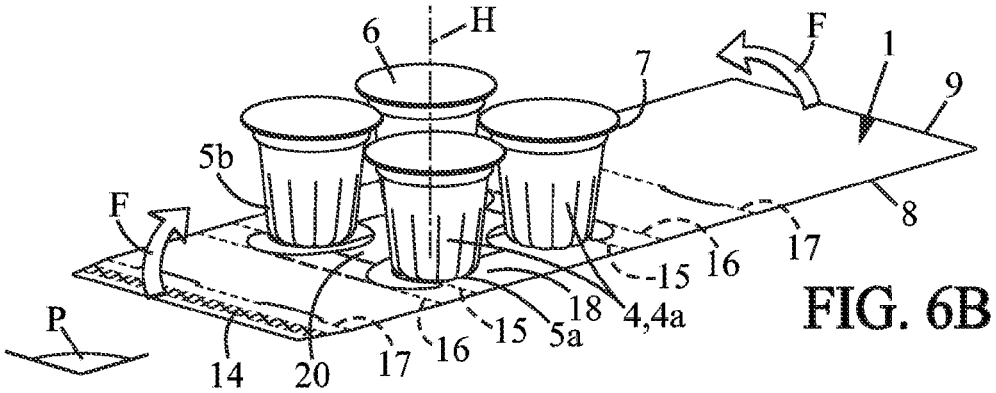
Figure 6C:
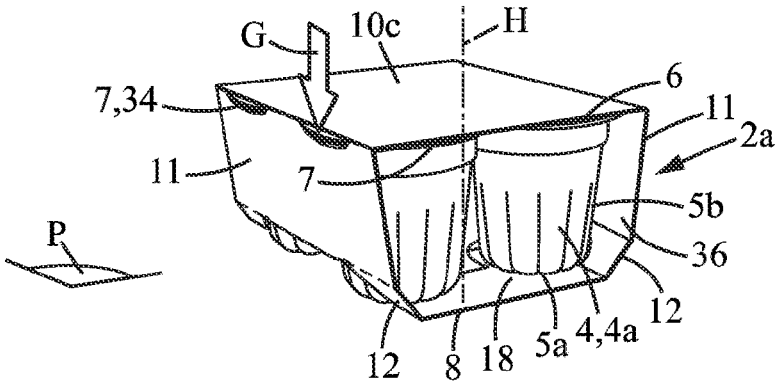
Figure 6D:
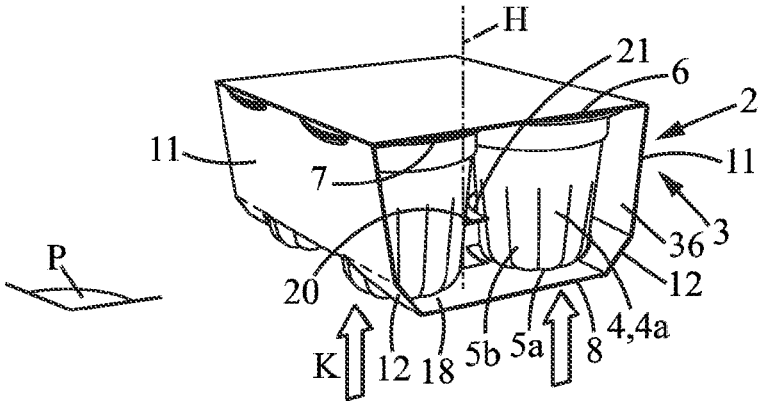

FIGS. 6A to 6D are four perspective diagrams illustrating the process for the production of a pack such as the one of FIG. 4, namely the flat blank of FIG. 6A, the arrangement of the four wedging cartons on the blank of FIG. 6B, the embodiment of the intermediate packaging of FIG. 6C, and the embodiment of the final packaging of FIG. 6D.

Figure 7:
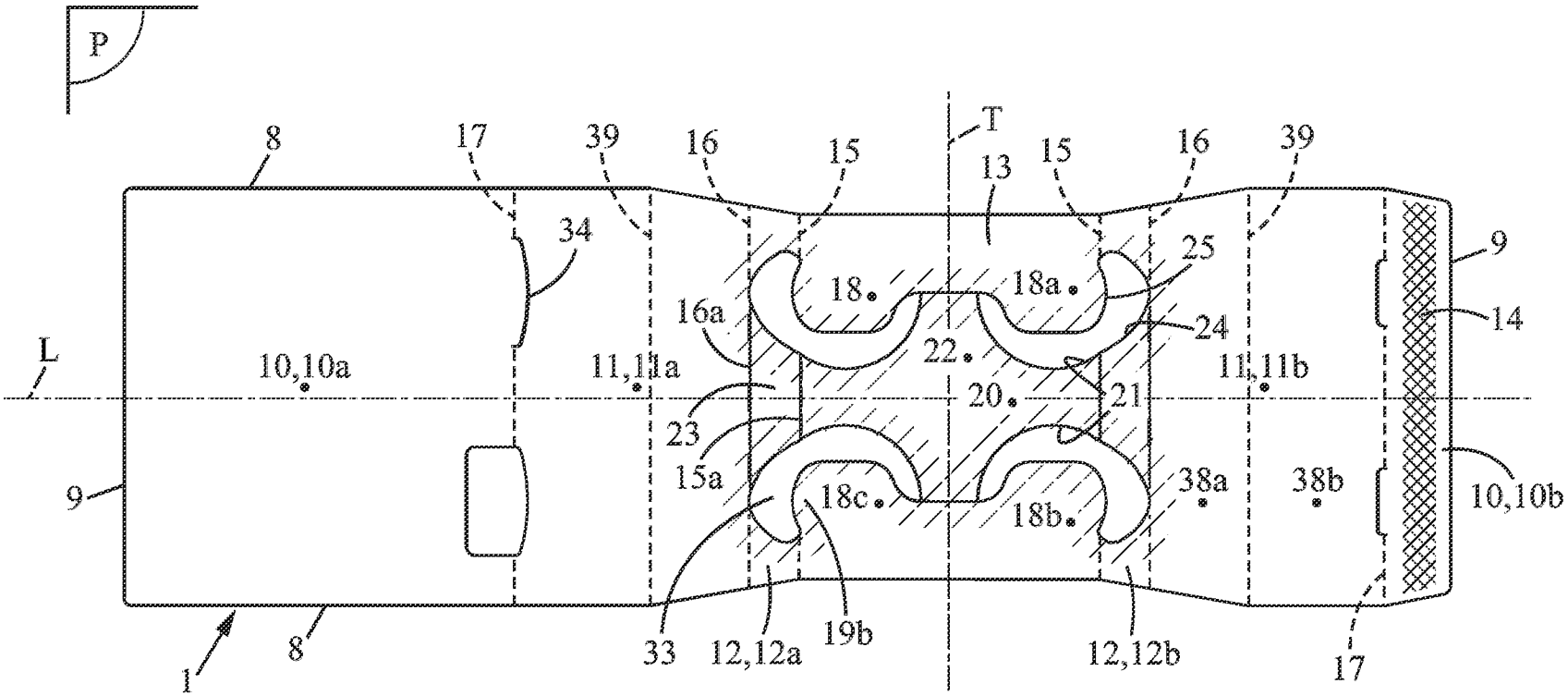

FIG. 7 is a view, in elevation, of another possible blank embodiment according to the invention, shown flat, designed for the production of a pack having two layers of four cartons each, with the four cartons of the base carton layer being wedging cartons.

Figure 8:
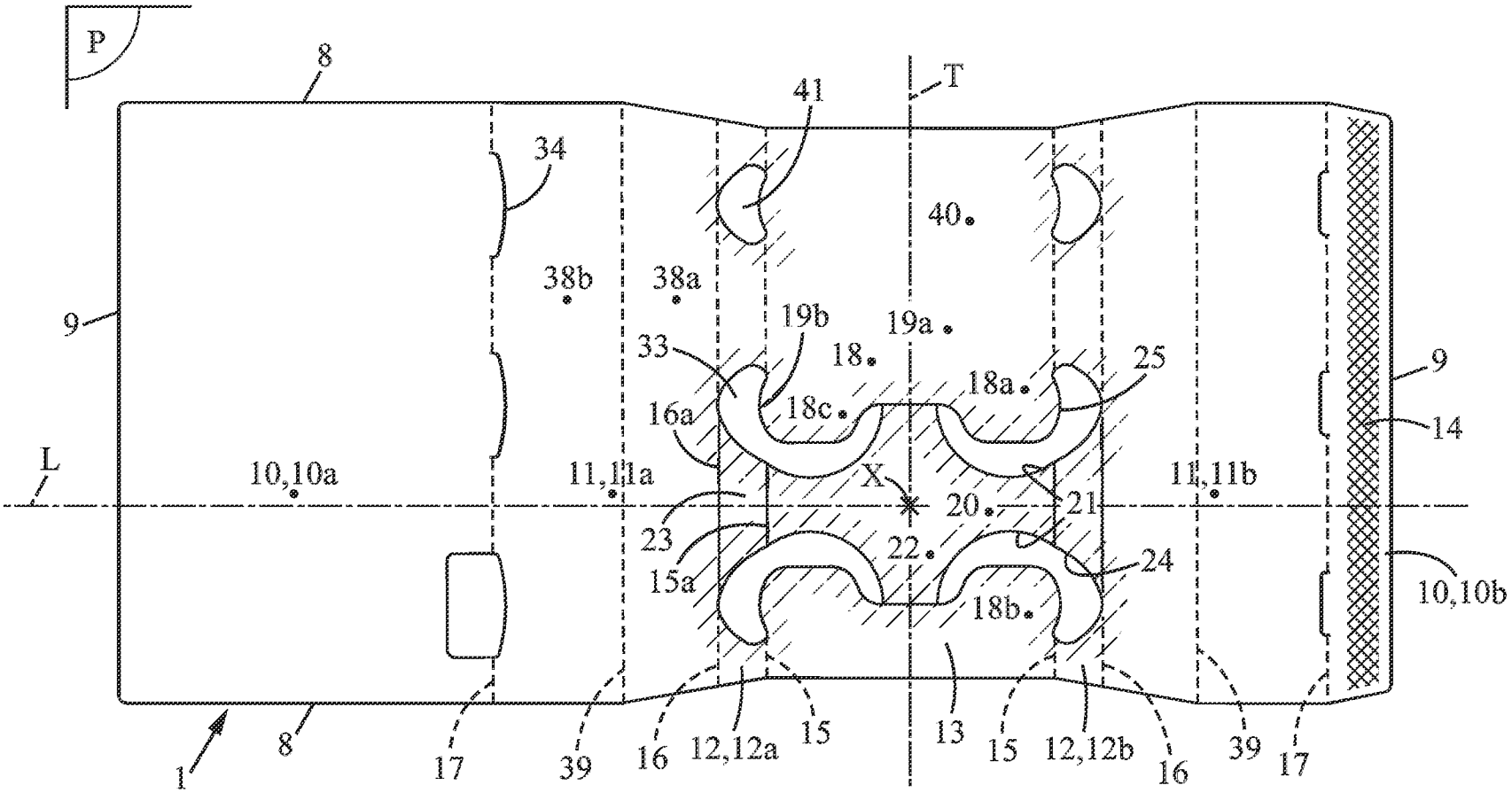

FIG. 8 is a view, in elevation, of another possible blank embodiment according to the invention, shown flat, designed for the production of a pack having two layers of six cartons each, four cartons of six cartons of the base carton layer being wedging cartons and two cartons being additional layer cartons.

Figure 9:
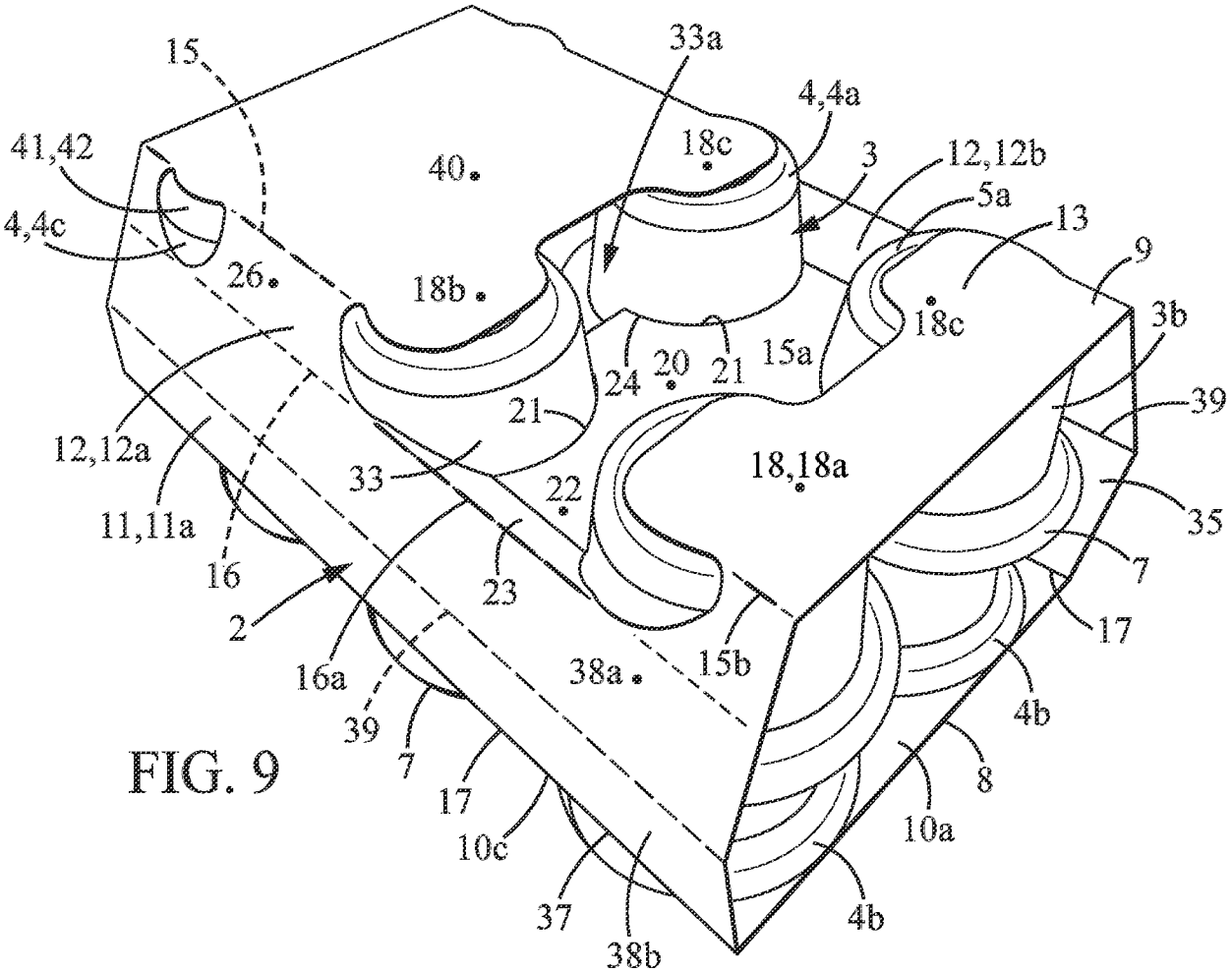

FIG. 9 is a view, in perspective, from the bottom, of the pack produced with the blank of FIG. 8.

A flat cardboard blank 1 is designed for the formation of a packaging 2 (which is referred to as final packaging), as well as an intermediate packaging 2*a* produced in an intermediate stage of the process for production of a pack 3, with the final packaging 2 being part of the pack 3 also comprising cartons 4, including four cartons termed "wedging cartons 4*a*."

The packaging 2 is of the tubular envelope type, and it is produced by expanding in volume and the closing on itself of the blank 1, in such a way as to encompass the cartons 4 of the pack 3, which are thus kept grouped.

"Tubular envelope" is defined as meaning that the packaging 2, 2*a*, which overall has six surfaces and which comes in a general parallelepiped shape, comprises four closed adjacent surfaces and two opposite open surfaces 36.

The tem "pack" is to be understood as meaning a lot formed by several cartons 4 presented grouped in (a) layer(s)—with superposition in case of a number of layers—in longitudinal rows and in transverse rows, in a packaging such as in this case, a tubular cardboard envelope, so as to form a joint unit, designed to be stored, handled, moved, put up for sale and sold as such.

The cartons 4 that the pack 3 comprises include at least the four wedging cartons 4*a*. The purpose of the qualification of "wedging carton 4*a*" is to distinguish such a carton from a possible other carton of the pack 3, namely an upper layer carton (top or intermediate) 4*b* and an additional layer carton 4*c*. In the description, the expression "positively spaced and wedged carton 4*a*" applies to a wedging carton 4*a*, once it is effectively positively spaced and wedged, relative to the other wedging cartons 4*a*, while the expression "wedging carton 4*a*" applies to such a carton 4*a* that is not yet positively spaced and wedged.

The description with reference to FIGS. 1 to 6 relates to the particular embodiment of a pack 3 of cartons 4, having a single layer—termed "base" layer—of four wedging cartons 4*a*, two by two, side by side, and opposite one another, arranged in a square, positively spaced and wedged. The object of this particular case is an elementary blank 1, an elementary packaging 2, and such an elementary pack 3.

However, more generally, the object of the invention is also any blank 1, any packaging 2, and any pack 3, made from or comprising or derived from such an elementary blank 1, such an elementary packaging 2, and such an elementary pack 3, or including its spacing/wedging means. Such embodiments are illustrated in a non-limiting manner by FIGS. 7 to 9, showing that a pack 3 can comprise two layers of cartons and that the base carton layer can comprise other cartons than the four wedging cartons 4*a*. In all of the embodiments that can be considered entering into the scope of the invention, the pack 3 includes the four wedging cartons 4*a* of the base carton layer of the elementary pack, which are positively spaced and wedged on their side walls in the vicinity of their bottom walls, in accordance with the invention.

The cartons of a possible carton layer other than the base carton layer, such as a top layer or an intermediate layer, are upper layer cartons 4*b*, sometimes referred as "upper cartons 4*b*," for short.

The possible cartons of the base carton layer other than the wedging cartons are additional layer cartons 4*c*, sometimes referred to as "additional cartons 4*c*," for short.

The numerical reference 4 designates the cartons of the pack 3, in a generic way.

Since pack 3 always comprises a base carton layer, it always comprises a top carton layer. When the pack 3 comprises a single carton layer (FIGS. 1 to 6), the base carton layer and the top carton layer form one and the same carton layer. When the pack 3 comprises two layers (FIGS. 7 to 9), the base carton layer and the top carton layer are separate, with the cartons of the top layer being superposed on the cartons of the base carton layer. Finally, the carton 3 can comprise three or a larger number of layers of cartons, then also having one or more intermediate carton layers.

"Cardboard" is defined as meaning a layer material, such as the one commonly used or adapted to a blank having the indicated destination. Such a cardboard should be neither too rigid nor too flexible. It should be able to be folded at the location of grooved lines, provided for this purpose.

"Carton" 4 is defined as meaning a container as has been described in the introductory part and whose characteristics need not be described again here, it being recalled that such a carton 4, which has a certain stability allowing it to be self-supporting, comprises a bottom wall 5*a*, a side wall 5*b* that is closed on itself with an opening opposite to the bottom, and a top closure 6, such as, typically, a lid placed on or connected to a collar 7 that projects radially around the opening. As appropriate, the cartons 4 are individualized or else they are connected to one another, for example by their collars 7, in such a way as to form a pallet of cartons 4. Within the context of the invention, the cartons 4 of a given pack 3 are analogous, quite especially identical, and they are filled with a certain content that may or may not be identical for the different cartons 4, and closed.

"Flat" in the expression "flat blank" is defined as meaning that the blank 1 is used so as to be found at least essentially in one and the same plane P. Unless it is expressed otherwise, the term "blank" 1, without any other specification, is to be understood as pertaining to the flat blank 1, in contrast to the blank 1 that is expanded in volume and that then forms the intermediate packaging 2*a* or the final packaging 2.

Reference is now made to FIGS. 1 to 6 relative to the case of an elementary pack 3 that has a single layer of base cartons of four wedging cartons 4*a*, two by two, side by side, and opposite one another, arranged in a square, which are, in the pack 3, thus positively spaced and wedged.

It is possible to define, relative to the blank 1 in the plane P, a longitudinal direction and a transverse direction that are perpendicular to one another, as well as a direction that is perpendicular or essentially perpendicular to the plane P.

The blank 1 has a general rectangular shape, and it is limited by two free edges 8 in the longitudinal direction and two free edges 9 in the transverse direction. In the embodiment shown, the free edges 8, 9 are rectilinear, but in other embodiments, they cannot be so, being, for example, scalloped. The two free edges 8 delimit the two edges of two open surfaces 36 of the packaging 2, 2*a*.

The blank 1 comprises, arranged one after the other in the longitudinal direction and between the two transverse edges 9, extending transversely, a first top panel 10*a*, a first side panel 11*a*, a first connecting panel 12*a*, a base panel 13, a second connecting panel 12*b*, a second side panel 11*b*, and a second top panel 10*b*.

"Panel" is defined as meaning a flat piece in layer form, made of cardboard in this case, delimited by an edge comprising grooved lines and/or cutout lines.

The blank 1 also comprises a means 14 for connecting two top panels 10*a*, 10*b*, one with the other for the closing on itself of the blank 1 that is expanded in volume with formation of a top wall 10*c*. For example, the first top panel 10*a* is wide (in the longitudinal direction), designed to form the entire surface of the top panel 10*c*, whereas the second top panel 10*b* is narrow (in the longitudinal direction), like a flap, and provided with attaching glue 14, capable of coming to the front of the first top panel 10*a*, on its transverse free edge 9. Such an embodiment is not exclusive of others, for example by means of top panels 10*a* and 10*b* having analogous dimensions or a connecting means by cooperation of slots and notches.

In a generic way, a top panel is referred to by the numerical reference 10, and in an analogous way, a side panel is referred to by the reference 11 and a connecting panel by the reference 12.

The blank 1 also comprises cutout lines, and grooved lines in the transverse direction. These lines are capable of and designed for the relative folding of panels 10, 10*a*, 10*b*, 11, 11*a*, 11*b*, 12, 12*a*, 12*b* and 13, the expanding in volume of the blank 1 and the composition of the final packaging 2 and the pack 3. Such cutout lines are formed by using a cutting tool. Such grooved lines are well known in the field of packaging and cardboard and make it possible to fold two adjacent panels in a relative way in a predefined location. Such grooved lines are formed by using a grooving tool. It is understood that the expression "grooved line" is to be understood in the broadest way as meaning that the line is suitable for and designed for the relative folding of two adjacent panels.

The blank 1 comprises two base grooved lines 15 between the base panel 13 and the two connecting panels 12, 12*a*, 12*b*, two intermediate grooved lines 16 between the two connecting panels 12, 12*a*, 12*b*, and the two side panels 11, 11*a*, 11*b* and two top grooved lines 17 between the two top panels 10, 10*a*, 10*b*, and the two side panels 11, 11*a*, 11*b*.

The blank 1 is such that, in the longitudinal direction, the two side panels 11*a* and 11*b* have the same dimension and the two connecting panels 12*a* and 12*b* themselves have the same dimension.

The blank 1 comprises, in the plane P, a longitudinal median axis L, of longitudinal direction L, a transverse median axis T of the transverse direction, with an intersection X. The blank 1 also comprises a normal axis H, perpendicular or essentially perpendicular to the plane P. This axis H is also called axis of elevation of packaging 2, 2*a*. This axis H is also perpendicular or essentially perpendicular to the plane of movement of the conveying means and the conveying means themselves, of the production line of packs 3. When the packs 3 are in the process of being put together or in the usual position of storage and display, the axis H is vertical or essentially vertical. The blank 1 is symmetrical or essentially symmetrical relative to the longitudinal median axis L. It is symmetrical or essentially symmetrical relative to the transverse median axis, if top panels 10*a* and 10*b* are abstracted. As for the intersection X, it is located essentially in the center of the base panel 13.

In one possible embodiment, on the one hand, the longitudinal dimension of the connecting panel 12, 12*a*, 12*b*, which corresponds to the separation between the intermediate grooved line 16 and the base grooved line 15 of this connecting panel 12, 12*a*, 12*b*, is between on the order of 30% to 50%, and more particularly on the order of 40%, of the longitudinal dimension of a side panel 11, 11*a*, 11*b*, which corresponds to the separation between the intermediate grooved line 16 and the top grooved line 17 of this side panel 11, 11*a*, 11*b*. On the other hand, the longitudinal dimension of the unit formed by the base panel 13 and the two connecting panels 12*a* and 12*b*, which corresponds to the separation between the two intermediate grooved lines 16, is essentially equal to the longitudinal dimension of the top wall 10*c*, and in particular is essentially equal to the dimension of the first top panel 10*a*, in the embodiment described above, which corresponds to the separation between the transverse free edge 9 and the top grooved line 17*a* of the first top panel 10*a*. Finally, the longitudinal dimension and the transverse dimension of the base panel 13 are of the same order of magnitude, with the first being able to be, however, smaller than the second, in such a way that the cartons 4 are separated from the two open surfaces opposite, toward the inside of the packaging 2, 2*a*. Such an embodiment is not limiting.

In a possible embodiment where the cartons 4 are designed to accommodate amounts of contents for individual use and for joint use, with a height in the axial direction of the carton 4—between its bottom part 5*a* and its top closure 6—on the order of 6 cm and a cylindrical side wall 5*b*, with a diameter on the order of 5 cm to 6 cm, the longitudinal dimension of the base panel 13 can be on the order of 8 cm to 9 cm, the longitudinal dimension of the connecting panel 12, 12*a*, 12*b* on the order of 2 cm, the longitudinal dimension of the side panel 11, 11*a*, 11*b* on the order of 5 cm to 6 cm, and the longitudinal dimension of the first top panel 10*a* on the order of 12 cm to 13 cm, with the blank 1 having a total longitudinal dimension on the order of 37 cm to 40 cm, and a total transverse dimension on the order of 14 cm to 15 cm. Such an embodiment is not limiting.

The blank 1 also comprises a part for receiving cartons 18 that is capable of receiving and designed to receive four wedging cartons 4*a* by their bottom walls 5*a*. It is thereby necessary to understand that each wedging carton 4*a* rests on the receiving part 18 by its bottom wall 5*a*, in particular its periphery in the case where the bottom wall 5*a* is curved with convexity toward the inside of the carton 4.

The carton receiving part 18 (sometimes referred to as "receiving part 18," for short) extends completely or at least essentially over a part 19*a* of the base panel 13, and, if necessary, can extend over a part 19*b* of the connecting panels 12, 12*a*, 12*b*. In the embodiment that is shown in the figures, the receiving part 18 extends over portions of the edges of the connecting panels 12, 12*a*, 12*b* that are adjacent to the base grooved lines 15. Here, this part 19*b* has a very limited area compared to that of the part 19*a*. With the blank 1 that comprises two connecting panels 12, 12*a*, 12*b* and that is designed with four wedging cartons 4*a*, the part 19*b* is in four sub-parts, two per connecting panel 12, 12*a*, 12*b*. In the case where a part 19*b* is provided, the base grooved lines 15 are interrupted in the zone 37 in the part 19*b*, which thus remains coplanar with the part 19*a*.

The blank 1 also comprises a spacing/wedging part of cartons 20 (sometimes referred to as "spacing/wedging part 20," for short), coming from the base panel 13, with cutout lines. This spacing/wedging part 20 is capable of expanding and designed to expand in volume relative to the receiving part 18, in such a way as to put together, by segments of its edge cutout line 24—more specifically by the section of these segments in the thickness of the cardboard—stopping edges 21 of the wedging cartons 4*a*, suitable for stopping them on their side walls 5*b*, in the vicinity of their bottom walls 5*a*.

The spacing/wedging part 20 is continuous and made of a single piece for the four wedging cartons 4*a*. It is formed, more particularly put together, by a portion 22 of the base panel 13 and by a portion 23 of the connecting panels 12, 12*a*, 12*b*, in two sections, one section per connecting panel 12, 12*a*, 12*b*.

The portion 22 of the base panel 13 extends and is arranged transversely in the median and arranged longitudinally in the median. Likewise, the portion 23 of the connecting panels 12, 12*a*, 12*b* extends and is arranged transversely in the median, and arranged longitudinally in the median.

"Portion [that] extends and is arranged transversely in the median" 22, 23 is defined as meaning both, on the one hand, that the spacing/wedging part 20, if it extends well into the transverse direction, extends only over a portion only of the space limited by the two longitudinal free edges 8, and not over this entire space, and, on the other hand, that the spacing/wedging part 20 extends in the transverse direction, by being arranged axially or essentially axially relative to the transverse median axis T.

"Portion arranged longitudinally in the median" 22, 23 is understood as meaning that the spacing/wedging part 20 extends in the longitudinal direction by being arranged axially or essentially axially relative to the longitudinal median axis L.

A portion that extends and is arranged transversely in the median and arranged longitudinally in the median is named "longitudinally median transverse portion," for short.

Because of the two connecting panels 12, 12*a*, 12*b*, the portion 23 of the connecting panels 12 is in two separate sections, one for the first connecting panel 12*a* and the other for the second connecting panel 12*b*.

The longitudinally median transverse portion 22 of the base panel 13 and the sections of the longitudinally median transverse portion 23 of the connecting panels 12, 12*a*, 12*b* together have a cross shape with four large branches joined by curved edges.

According to a possible, nonlimiting embodiment, the longitudinally median transverse portion 22 of the base panel 13 extends in the transverse direction over approximately half the transverse dimension of the base panel 13.

Because of the longitudinally median arrangement of the spacing/wedging part 20, the receiving part 18, more especially its part 19*a*, is in two separate portions 18*a*, 18*b*, each for two wedging cartons 4*a*. They are located on either side, transversely, of the longitudinally median transverse portion 22, of the base panel 13.

The bottom walls 5*a* of the wedging cartons 4*a* do not occupy the entire surface of the receiving part 18 but only a fraction: the one that is closer to the longitudinal median axis L. The bottom walls 5*a* do not occupy the fraction of the receiving part 18 that is adjacent to the longitudinal edges 8, in such a way that the wedging cartons 4*a* are separated from the two open surfaces 36 of the packaging 2, 2*a*, limited by the two longitudinal free edges 8. In the embodiment of FIG. 1A, for example, the area of the receiving part 18 where the bottom walls 5*a* of the four wedging cartons 4*a* rest comes in the form of four sub-portions 18*c* having an essentially circular contour, arranged two by two opposite one another.

A continuity approach exists between, on the one hand, the spacing/wedging part 20, taken as a whole, and, on the other hand, the receiving part 18. A continuity approach also exists between, on the one hand, the spacing/wedging part 20, taken as a whole, and, on the other hand, the portions of the connecting walls 12, 12*a*, 12*b*, other than the sections of the portion 23 of the spacing/wedging part 20.

The expression "continuity approach," applied to a panel, a panel part, a grooved line, a functional part (such as a spacing/wedging part 20 or a receiving part 18) is to be understood as meaning a structural interruption in the continuity of this panel, this panel part, this grooved line, this functional part, in such a way that the two fractions (such as portions or segments) that result therefrom are not linked and consequently can, at least to a certain extent, be moved relative to one another, independently of one another, regardless of whether or not they are adjacent.

Such a continuity approach is typically a point, slender or surface cutout of the blank 1.

The spacing/wedging part 20 is limited in the longitudinal direction by—and extends between—two median segments 16*a* of the two intermediate grooved lines 16. Thus, the spacing/wedging part 20 extends on either side of two median segments 15*a* of the two base grooved lines 15.

For each intermediate grooved line 16, there is a continuity approach between its median segment 16*a* and its two end segments 16*b*.

For each base grooved line 15, there is a continuity approach between its median segment 15*a* and its two end segments 15*b*.

The intermediate median grooved segment 16*a* and the base median grooved segment 15*a* together delimit one of the two sections of the longitudinally median transverse portion 23 of the connecting panel 12, 12*a*, 12*b*.

This intermediate median grooved segment 16*a* and this base median grooved segment 15*a* form an irreversible-pivot double hinge of the corresponding section of the longitudinally median transverse portion 23, the connecting panel 12, 12*a*, 12*b* relative to, in the first place, the adjacent side panel 11, 11*a*, 11*b*. They also form an irreversible-pivot double hinge of the corresponding section of the longitudinally median transverse portion 23, of the connecting panel 12, 12*a*, 12*b*, relative to, in the second place, the longitudinally median transverse portion 22 of the base panel 13.

As a result, the base median grooved segments 15*a* and intermediate median grooved segments 16*a* of the spacing/wedging part 20 form two irreversible-pivot double hinges. Also, consequently, the longitudinally median transverse portion 22 of the base panel 13 can be separated from the receiving part 18 along the axis H.

In one embodiment, the intermediate median grooved segments 16*a* and the base median segments 15*a* are grooved and provided with alternately intermittent cut-outs.

The spacing/wedging part 20 is limited in the transverse direction, on either side, by two edge cutout lines 24 of the spacing/wedging part 20. These edge cutout lines 24 are continuous, curved, and advance overall in the longitudinal direction. These edge cutout lines 24 have segments that form stopping edges 21 of the wedging cartons 4*a*.

A receiving portion 18*a*, 18*b* of the receiving part 18 is limited in the transverse direction on either side, on the one hand, opposite the spacing/wedging part 20 directly by a longitudinally free edge segment 8, and, on the other hand, toward the spacing/wedging part 20 by an edge cutout line 25 of the receiving portion 18*a*, 18*b*. Such an edge cutout line 25 is continuous, curved and advances overall in the longitudinal direction, in such a way as to reach the two base grooved lines 15.

Thus, for the base panel 13, there is a continuity approach between its longitudinally median transverse portion 22 and its two end portions 18*a*, 18*b*, which are the portions for receiving cartons 18*a*, 18*b*. And for each of the two connecting panels 12, 12*a*, 12*b*, there is a continuity approach between its section of longitudinally median transverse portion 23 and its two end portions 26.

Each edge cutout line 24 of the spacing/wedging part 20 comprises two lateral segments 27 and, between the two, a cutout median segment 28. These segments 27, 28 are cutout lines.

A cutout lateral segment 27 has a side end 29 on the adjacent intermediate grooved line 16, and a median end 30 toward the transverse median axis T, joining with the end of the cutout median segment 28. In the embodiment shown, at the side end 29, the cutout lateral segment 27 is at least essentially tangent to the adjacent intermediate grooved line 16.

The term "end" in relation to a line is to be understood as meaning that the end in question is either exactly on the line in question or adjacent to it and very close to it.

The cutout lateral segment 27 extends with a rotated convexity toward the spacing/wedging part 20, for example with a general shape that is close or similar to the one of a circular arc whose angle in the center is on the order of 180°.

Such a cutout lateral segment 27 is capable of being and designed to be part of a stopping edge 21.

A cutout median segment 28 extends in the longitudinal direction. In the embodiment shown, it is positioned at least essentially on the straight line joining two side ends 29 opposite one another in the longitudinal direction. Its length corresponds, with the packaging 2 and the pack 3 that are put together, to the separation between two adjacent wedging cartons 4*a* in the longitudinal direction, in the longitudinally median transverse portion 22 of the base panel 13.

Such a cutout median segment 28 is not designed, in principle, to be part of, or to be part of in a substantial way, a stopping edge 21, being placed between two wedging cartons 4*a*.

In the embodiment shown, each cutout lateral segment 27 extends from the side end 29 to the adjacent connecting panel 12, 12*a*, 12*b* and toward the adjacent end portion 26 of this connecting panel 12, 12*a*, 12*b* via a cutout lateral extension 31, which is a cutout line. This cutout lateral extension 31 extends between the side end 29 up to a side terminal end 32, over the adjacent base grooved line 15. This cutout lateral extension 31, which extends a cutout lateral segment 27, extends with a convexity that is analogous to the latter and, for example, with a general shape that is close or similar to that of a circular arc whose angle in the center is on the order of 90°.

Such a cutout lateral extension 31 is capable of being and designed to be part of a stopping edge 21.

The angles in the center for a cutout lateral segment 27—on the order of 180°—and for a cutout lateral extension 31—on the order of 90°—lead to an angle at the center for a cutout lateral segment 27 and a cutout lateral extension 31 that are adjacent, on the order of 270°. These angle values in the center are not limiting; however, the angles in the center have to have values such that stopping the wedging cartons 4*a* is satisfactorily ensured, as it was disclosed.

The smallest separation in the transverse direction between two lateral segments 27 opposite the two edge cutout lines 24 corresponds, with the packaging 2 and the pack 3 being put together, to the separation between two adjacent wedging cartons 4*a* in the transverse direction.

The edge cutout line 25 has, on each side, a side terminal end 32 that is on a base grooved line 15 and that is essentially common with the side terminal end 32 of the adjacent cutout side end 31.

The edge cutout line 25 is arranged opposite and separated by a continuous empty space 33, from the cutout lateral extension 31 and a first length 27*a* of the cutout lateral segment 27 adjacent to the side end 29. This first length 27*a* is a cutout line.

This empty space 33 has a general growing shape, and it is capable of working with and designed to work with the side wall 5*b* of a wedging carton 4*a*. Since the receiving part 18 and the spacing/wedging part 20 are designed to be offset relative to one another along the axis H, the empty space 33 makes it possible for the stopping edges 21 to work with the side walls 5*a* of the wedging cartons 4*a*, as indicated.

In the embodiment shown in FIGS. 1A and 1B, the edge cutout line 25 is common with a second length 27*b* of the cutout lateral segment 27 and with the cutout median segment 28. This second length 27*b* is a cutout line.

In another embodiment, the edge cutout line 25 is arranged opposite and separated by an empty space from this second length 27*b* of the cutout lateral segment 27 and from this cutout median segment 28.

The cutout lateral segment 27 consists of the first length 27*a* and the second length 27*b* end to end.

An edge cutout line 25 comprises a curved segment for the receiving sub-portion 18*c* that comprises a general shape that is close or similar to that of a circular arc whose angle in the center is on the order of 180° to 270°, except for the cutout median segment 28.

If an exception is made for the cutout median segments 28, which remain free, each being placed between two wedging cartons 4*a* opposite, the stopping edges 21 comprise all or part of the edge cutout lines 24 of the spacing/wedging part 20 and their lateral extensions 31, in particular substantially comprise all of the edge cutout lines 24 and their lateral extensions 31. More particularly, the stopping edges 21 are formed by, in particular are substantially put together by, the cutout lateral segments 27 and the cutout lateral extensions 31.

In a conventional way, each top grooved line 17 can comprise cutout segments 34 of top grooved lines, each capable of working and designed to work with the edge of the top closure 6 and the collar 7 of a carton 4 of the top carton layer.

The blank 1 that is described can be developed and adapted in particular to the function of the shape of the cartons 4.

Reference is now made to FIG. 7, which represents a blank 1 that is especially capable of and designed for a pack 3 having two layers of four cartons, namely the base layer that comprises the four wedging cartons 4*a* and a top layer that comprises four upper cartons 4*b*.

The four wedging cartons 4*a* of the base carton layer placed by the base panel 13 are positively spaced and wedged in their side walls 5*b* in the vicinity of their bottom walls 5*a* with spacing/wedging means in accordance with those described above in relation to FIGS. 1 to 6.

The four upper cartons 4*b* of the top carton layer rest by their bottom walls 5*a* on the top closures 6 of the four wedging cartons 5*a* of the base carton layer. The top carton layer is therefore carried by the base carton layer.

Relative to the embodiment of FIGS. 1 to 6, and in the nonlimiting embodiment illustrated by FIG. 7, it is provided only that the blank 1 comprises cutout segments for the collars of the four wedging cartons of the base carton layer, because these cutout segments would be located not at the location of a grooved folding line but in the center of the side panels 11, 11*a*, 11*b*, which could be ill-proportioned and affect the facing that these panels obtain.

In contrast, the longitudinal dimension of a connecting panel 12, 12*a*, 12*b*—the separation between the intermediate grooved line 16 and the base grooved line 15 of this connecting panel 12, 12*a*, 12*b*—is between on the order of 15% to 25%, more particularly on the order of 20%, of the longitudinal dimension of a side panel 11, 11*a*, 11*b*—the separation between the intermediate grooved line 16 and the top grooved line 17 of this side panel 11, 11*a*, 11*b*.

Furthermore, in the longitudinal direction, each side panel 11, 11*a*, 11*b* is in two portions 38*a* and 38*b*, separated by a folding line 39, with each portion 38*a*, 38*b* corresponding to a carton layer. In other embodiments, instead of a folding line 39, a folding zone can be provided. In any case, this folding line or zone 39 is capable of being and designed to be in the pack 3, facing collars of the cartons of the base carton layer. Thus, the final packaging 2 encompasses the shape of cartons 4 of the pack 3. As illustrated by FIG. 9, the portions 38*a* and 38*b* are inclined relative to one another by an angle that is slightly smaller than 180°. If the pack 3 comprises more than two layers of cartons, each side panel 11, 11*a*, 11*b* can comprise a larger number of portions and a larger number of folding lines or zones. However, as for the embodiment of FIGS. 1 to 6, it is possible that, in the longitudinal direction, each side panel 11, 11*a*, 11*b* is in a single portion.

Furthermore, the two longitudinal free edges 8 can be a little closer to one another in the base panel 13 and are separated from one another in such a way as to have the largest separation in the top panels 10, 10*a*, 10*b*.

Reference is now made to FIG. 8, which represents a blank 1 that is especially suitable for and designed for a pack that has two layers of six superposed cartons, four cartons of six cartons of the base carton layer being wedging cartons, and the other two cartons being additional cartons, as defined. Reference is likewise made to FIG. 9 that shows the pack 3 produced with the blank of FIG. 8.

What has been described above with reference to the embodiment of FIG. 7 relative to the existence of two superposed carton layers can be transposed to the embodiment of FIGS. 8 and 9 relative to the existence per se of these two layers.

Furthermore, relative to the embodiment of FIGS. 1 to 6, the blank 1 of FIGS. 8 and 9 is such that, in the transverse direction, it comprises, toward one of its longitudinal free edges 8, an extension 40 of the top panels 10, 10*a*, 10*b*, side panels 11, 11*a*, 11*b*, connecting panels 12, 12*a*, 12*b*, and base panel 13. Consequently, the corresponding receiving portion 18*a*, 18*b* of the carton receiving part 18 is limited opposite the spacing/wedging part 20, not directly by the corresponding longitudinal free edge 8, but indirectly by this longitudinal free edge 8, with the presence between them of the extension 40 of the base panel 13.

The extension 40 can be provided as well toward one as toward the other or toward the two longitudinal free edges 8.

Such an extension 40 of the base panel 13, whose dimension in the transverse direction is adapted to the use, is designed for receiving at least two additional cartons 4*c*, arranged side by side and opposite one another, and in the case of FIGS. 8 and 9, specifically two additional cartons 4*c*. Thus, the cartons 4 of the base carton layer are arranged in three longitudinal rows and two transverse rows. The object of the invention is also the case where a larger number of longitudinal rows are provided.

Relative to the embodiment of FIGS. 1 to 6, in the one of FIGS. 8 and 9, the longitudinally median transverse portion 22 of the base panel 13 of the spacing/wedging part 20 extends transversely on the order of one-third of the transverse dimension of the base panel 13.

The cartons 4 of the base carton layer comprise a collar 7, and they are connected to one another by these collars 7. Thus, the two additional cartons 4*c* that are not held positively spaced and wedged by the spacing/wedging means in accordance with those described above are held for the reason that they are combined solidly by their collars 7 with four wedging cartons 4*a* that themselves are held positively spaced and wedged. In the blank 1, empty spaces 41 are provided with which portions 42 of the side walls 5*b* of the additional cartons 4*c* work.

The invention also relates to a process for the production of the packaging 2 and the pack 3, described more particularly with reference to the embodiment of FIGS. 1 to 6.

For this process, the following are available: a flat cardboard blank 1, four wedging cartons 4*a*, and, if necessary, upper cartons 4*a* and additional cartons 4*c*, designed to be part of the pack 3 (FIG. 6A).

Then (FIG. 6B), the four wedging cartons 4*a* are arranged in a base carton layer on the receiving part 18, with the blank 1 then being arranged horizontally overall, such that the wedging cartons 4*a* are arranged two by two, side by side, and opposite one another, in a square. More specifically, the four wedging cartons 4*a* are placed on the four sub-portions 18*c* of the receiving part 18, one per wedging carton 4*a*.

Then (arrow F of FIG. 6B), without changing the positioning of the wedging cartons 4*a*, the blank 1 is expanded in volume around cartons 4 of the pack 3 by folding two connecting panels 12, 12*a*, 12*b* around the two base grooved lines 15, two side panels 11, 11*a*, 11*b*, around two intermediate grooved lines 16, and two top panels 10*a* and 10*b*, around the two top grooved lines 17.

Then (arrow G of FIG. 6C), in an intermediate stage of the process, the two top panels 10*a* and 10*b* are arranged in a coplanar way, for example one on the other, and they are connected to one another, in such a way as to close on itself the blank 1 that is expanded in volume, to form the top wall 10*c*, by using the connecting means 14, and to put together a so-called "intermediate" packaging 2*a*, surrounding the cartons 4 of the pack 3. The packaging 2*a* is termed "intermediate" for the reason that it is produced in an intermediate stage of the process and that, while resembling the final packaging 2, it is distinguished relative to the spacing/wedging part 20.

In this intermediate stage, it is possible to make the collar 7 of each carton 4 of the base carton layer work with a cutout segment 34 of the top grooved line 17 with the suitable location, when such a cutout segment 34 is provided.

Either a blank 1 that is suitable for and designed for a pack 3 with a single carton layer is used, or a blank 1 that is suitable for and designed for several carton layers is used. And, either a blank 1 that is suitable for and designed for a base carton layer that comprises the four wedging cartons 4*a* is used, or a blank 1 that is suitable for and designed for a base carton layer that also comprises additional cartons 4*c* is used. As appropriate, and by means of using the suitable blank 1, either the four wedging cartons 4*a* are arranged in a single base carton layer or first the base carton layer and then the upper carton layer are arranged, in particular from above. And, either the four wedging cartons 4*a* are arranged in a base carton layer put together from these four cartons 4*a* or these four cartons 4*a* are arranged in a base carton layer that also comprises additional cartons 4*c* from the side with an extension 40 or from each of the two sides with extensions 40 of the blank 1.

An intermediate packaging 2*a* is illustrated quite especially by FIGS. 2 and 6C in the case of the embodiment of FIGS. 1 to 6. It is now described with the relative position that such a packaging 2*a* has in a production line of the pack 3 using the process.

In the intermediate packaging 2*a*, the base panel 13 is arranged in the plane P, which is a lower plane of rest, which means that the receiving part 18 and the longitudinally median transverse portion 22 of the base panel 13 are coplanar or essentially coplanar.

The longitudinally median, transverse portion 23 and the two end portions 26 of the same connecting panel 12, 12*a*, 12*b* are coplanar or essentially coplanar. The two connecting panels 12, 12*a*, 12*b* are set up, toward the top, relative to the plane of the base panel 13 and form an oblique angle $\alpha$ with it.

The side panels 11, 11*a*, 11*b* extend beyond the connecting panels 12, 12*a*, 12*b* up to the top wall 10*c*. They form an oblique angle $\beta$ with the connecting panels 12, 12*a*, 12*b*.

The angles $\alpha$ and $\beta$ are close and in a typical embodiment on the order of 135°.

With such an embodiment, the connecting panels 12, 12*a*, 12*b* form smaller beveled corners. In contrast, the side panels 11, 11*a*, 11*b* extend perpendicular or essentially perpendicular relative to the plane of the base panel 13, up to the top wall 10*c*, arranged above and perpendicular to the base panel 13.

In the intermediate packaging 2*a*, the spacing/wedging part 20 has not been expanded in volume, and it has not been made operational. The wedging cartons 4*a* are held in the intermediate packaging 2*a* by the fact that their bottom walls 5*a* are against the receiving part 18, while the top wall 10*c* goes against the lids forming the closures 6. In addition, the collar 7 of each wedging carton 4*a* works with the cutout segment 34 of the top grooved line 17.

The detailed shape of the intermediate packaging 2*a* is adapted to the detailed shape of the cartons 4. The description of the intermediate packaging 2*a* that was just given therefore does not exclude others, in the case of cartons 4 of different shapes.

In contrast, and in the first place, the intermediate packaging 2*a* depends on what the blank 1 is according to the first embodiment (for a pack with a single carton layer) or according to the second embodiment (for a pack with several carton layers), with the side panels 11, 11*a*, 11*b* then having a dimension in the greater longitudinal direction, adapted to the number of carton layers. In the second place, the intermediate packaging 2*a* depends on the fact that the blank 1 is designed for a pack 3 whose base layer consists of four wedging cartons 4*a* or else a pack 3 whose base layer comprises four wedging cartons 4*a* and additional cartons 4*c*.

With the intermediate packaging 2*a* (FIG. 6C), the process comprises a final stage in which the spacing/wedging part 20 is stressed in a relative way in relation to the rest of the intermediate packaging 2*a* and cartons 4 to make the spacing/wedging part 20 operational, when the stopping edges 21 are positioned in a way adjacent to the side walls 5*b* of the wedging cartons 4*a* in the vicinity of their bottom walls 5*a*. This stress is shown in a diagrammatic way by the arrows K (FIGS. 3 and 6D).

The spacing/wedging part 20 is stressed in such a way that the longitudinally median transverse portion 22 of the base panel 13 is separated in a relative way from the receiving part 18 and in a relative way is moved toward the top wall 10*c*. This separation and this forward movement extend along the axis H of elevation of the packaging 2*a*, which axis H is perpendicular or essentially perpendicular to the receiving part 18, the longitudinally median transverse portion 22 of the base panel 13, and the top wall 10*c*.

At the same time, the two sections of the longitudinally median transverse portion 23, the two connecting panels 12, 12*a*, 12*b*, are pivoted around the irreversible-pivot double hinges 15*a*, 16*a*, in a relative way in relation to the end portions 26 of the two connecting panels 12, 12*a*, 12*b*. Most often, the end portions 26 of the two connecting panels 12, 12*a*, 12*b* remain stationary. In one embodiment, the longitudinally median transverse portion 23 of each connecting panel 12, 12*a*, 12*b* pivots around the intermediate median segment 16*a* by an angle on the order of 90°.

In its pivoting movement, each section of the longitudinally median transverse portion 23 of a connecting panel 12, 12*a*, 12*b* pivots around the intermediate median grooved segment 16*a* by passing beyond a stressed intermediate position where it is located in the plane that is defined by the two intermediate grooved lines 16. This intermediate position is stressed to the extent that the separation between the two intermediate median grooved segments 16*a* is slightly smaller than the sum of the dimensions, in the longitudinal direction, of the portions 22 and 23 of the spacing/wedging part 20. The longitudinally median transverse portion 23 of each of the connecting panels 12, 12*a*, 12*b* passes beyond the stressed intermediate position because of a certain flexibility of the cardboard of the blank 1, and because the segments 15*a*, 16*a*, forming a joint, are grooved and provided with intermittent cut-outs, and finally, an adequate stressing of the spacing/wedging part 20.

With the stressed intermediate position, the two sections of the longitudinally median transverse portion 23 of the connecting panels 12, 12*a*, 12*b* cannot return to their starting position before pivoting, as in the intermediate packaging 2*a*. This is why the two double hinges 15*a*, 16*a* can be termed "irreversible-pivot."

This being so, the spacing/wedging part 20, one expanded in volume and in position, and furthermore held on either side by the two intermediate median grooved segments 16, cannot change shape, collapse, or fail for the wedging cartons 4*a*.

For stressing the spacing/wedging part 20, in one embodiment, the longitudinally median transverse portion 22 of the base panel 13 is stressed directly. In particular, it is stressed at least toward the base median grooved segments 15*a*. In particular, only this longitudinally median transverse portion 22 is stressed directly, without directly stressing the longitudinally median transverse portion 23 of the connecting panels 12, 12*a*, 12*b*.

In the final stage of the process, the stopping edges 21 are moved toward the side walls 5*b* of the wedging cartons 4*a*, and they are positioned in a way adjacent to their side walls 5*b* in the vicinity of their bottom walls 5*a*. It is thus that the final packaging 2 of the pack 3 and the pack 3 itself are put together.

The process is analogous in the case of a pack 3 that has two or more than two layers of cartons. In the case of a pack 3 whose base carton layer comprises additional cartons 4*c*, only the spacing/wedging part 20 of the four wedging cartons 4*a* is stressed, while the part of the base panel 12 that comprises the receiving part 18 and the part—or each of the parts—formed by the extension 40, facing additional cartons 4*c*, is not stressed. Thus, the receiving part 18 and the part—or each of the parts—formed by the extension 40 are and remain coplanar, as is shown in FIG. 9.

Such a final packaging 2 is illustrated quite especially by FIGS. 3, 4, 5 and 6D in the case of a pack 3 that has a single base carton layer comprising four wedging cartons 4*a*. The final packaging 2, produced in the final stage of the process, is now described with reference to these figures.

In the final packaging 2, according to this embodiment, the receiving part 18 and the longitudinally median transverse portion 22 of the base panel 13 of the spacing/wedging part 20 are parallel or essentially parallel to one another and separated from one another along the axis H. Furthermore, the longitudinally median transverse portion 22 of the base panel 23 is arranged between the plane of the receiving part 18 and the plane of the top wall 10*c*. The spacing/wedging part 20 is therefore pushed inside the final packaging 2 in such a way as to be made operational for the wedging cartons 4*a*, in contrast to the intermediate packaging 2*a*.

The end portions 26 of the connecting panels 12, 12*a*, 12*b* are set up relative to the receiving part 18 by forming an oblique angle α, as for the intermediate packaging 2*a*.

The section of the longitudinally median transverse portion 23 and the end portions 26 of each of the two connecting panels 12, 12*a*, 12*b* form between them an angle γ, on the order of a right angle.

The section of the longitudinally median transverse portion 23 of the connecting panels 12, 12*a*, 12*b* form an acute angle θ with the side panels 11, 11*a*, 11*b*.

The side panels 11, 11*a*, 11*b* extend beyond the end portions 26 of the connecting panels 12, 12*a*, 12*b* up to the top wall 10*c* and form an oblique angle β, close to the angle α, such as on the order of 135°, with the end portions 26 of the connecting panels 12, 12A, 12*b*.

The stopping edges 21 are more particularly formed by—in particular are substantially put together by—the cutout lateral segments 27 and the cutout lateral extensions 31. Four stopping edges 21, one per wedging carton 4*a*, each stopping edge 21 formed by—in particular substantially put together by—an adjacent cutout lateral segment 27 and an adjacent cutout lateral extension 31, are thus provided. Such a stopping edge 21 has a general shape that is close or similar to that of a circular arc whose angle in the center is on the order of 270°. Although this value is not limiting, the angle in the center of each stopping edge 21 is to be suitable to ensure the stopping of the wedging carton 4*a* on a circular arc of a sufficient length to ensure its stopping function.

In one possible embodiment, the longitudinally median transverse portion 22 of the base panel 13 is spaced from the receiving part 18 on the order of one-third of the distance between the longitudinally median transverse portion 22 and the top wall 10*c*.

The detailed shape of the final packaging 2 is adapted to the detailed shape of the cartons 4. The description of the final packaging 2 that was just given is therefore not exclusive of others in the case of cartons 4 of different shapes.

In the case of a pack 3 that has two or more than two layers of cartons, the final packaging 2 is, overall, analogous to that of a pack 3 with a single layer of base cartons if it is only, primarily, that its dimension along the axis H is larger in such a way as to be adapted to the number of layers. Next, according to the embodiments, each of the side panels 11, 11*a*, 11*b* is either made of a single portion or made of two (or more) portions 38*a*, 38*b*, with one (or more) folding lines or zones 39, with two adjacent portions being inclined relative to one another by an angle that is slightly smaller than 180°. The final packaging 2 can comprise cutout segments 34 of top grooved lines 17 for the collars of the cartons 4 of the top layer.

In the case of a pack 3 whose base carton layer comprises additional cartons 4*c*, the final packaging 2 is, overall, analogous to the one for a pack 3 whose base carton layer consists of four wedging cartons 4*a*, if it is only, primarily, that its dimension in the transverse direction is larger, taking into account the presence of one or two extensions 40 and in adaptation to the number of longitudinal rows of additional cartons 4*c* by extension 40.

The invention also relates to a pack 3 that comprises four wedging cartons 4*a*, two by two and opposite one another of the type described above, and a final packaging 2, as has been described.

In such a pack 3, the wedging cartons 4*a* are received by their bottom walls 5*a* on the receiving part 18, the top wall 10*c* is applied to or adjacent to the closure 6 of cartons of the pack 3 that is part of the top layer, and the stopping edges 21 are placed in an adjacent way on the side walls 5*b* of the wedging cartons 4*a*, in the vicinity of their bottom walls 5*a*, in such a way as to ensure the spacing and the wedging of these cartons 4*a* in the vicinity of their bottom walls 5*a*.

According to the embodiments, the cartons 4 may or may not comprise a collar 7 toward the opening and may or may not be connected to one another by their collars 7. When the cartons 4 comprise a collar 7, these collars 7 can, concerning cartons of the top carton layer, work with the cutout segments 34 of the top grooved lines 17.

The stopping edges 21 are suitable for stopping the wedging cartons 4*a* on their side walls 5*b*, in the vicinity of their bottom walls 5*a*.

"Stopping the wedging cartons 4*a* on their side walls 5*b*" is defined as meaning that, in the pack 3, the wedging cartons 4*a* are prevented, at least to a certain extent, from moving in a relative way—at an inopportune moment—relative to the final packaging 2*a*, or from striking one another because the side wall 5*b* of each wedging carton 4*a* is adjacent to a given stopping edge 21 that is suitable for this carton 4*a*.

Stopping the wedging cartons 4*a* on their side walls 5*b* "in the vicinity of their bottom walls 5*a*" is defined as meaning that the part of the side wall 5*b* of each wedging carton 4*a* that, in the pack 3, is adjacent to the stopping edge 21 being considered is, for a substantial part, separated from the bottom part 5*a* in the axial direction of this carton 4*a*—between its bottom part 5*a* and its top closure 6—with a relatively small separation relative to the separation between the bottom part 5*a* and the top closure 6.

The "substantial part" of the part of the side wall 5*b* that is separated from the bottom part 5*a* is the one that corresponds to the part of the stopping edge 21 comprising the cutout lateral segment 27 and an adjacent part of the corresponding cutout lateral extension 31, from the side end 29. Actually, the additional part of the cutout lateral extension 31, ranging up to the side terminal end 32, on the adjacent base grooved line 15, is less and less separated and moves toward the bottom part 5*a* and at least essentially reaches the latter at the side terminal end 32.

For example, in a possible embodiment that is being considered, where the wedging cartons 4*a* have a height on the order of 6 cm, the separation between this substantial part of the side wall 5*b* and the bottom wall 5*a* can be on the order of 2 cm, with this embodiment not, however, being limiting, the separation being able to be different, smaller or larger.

The separation between this substantial part of the part of the side wall 5*b* and the bottom wall 5*a* is contingent upon the longitudinal dimension of the connecting panels 12, 12*a*, 12*b*, which is smaller than the one of the side panels 11, 11*a*, 11*b*. This separation would not be too small, at the risk of affecting the efficiency of the double hinges 15*a*, 16*a* of the spacing/wedging part 20 and of stopping the wedging cartons 4*a* that are too close to their bottom walls 5*a*. This separation would not be too large, at the risk of reducing the longitudinal dimension of the side panels 11, 11*a*, 11*b*.

The term "adjacent" relating to the side wall 5*b* of a wedging carton 4*a* and the corresponding stopping edge 21 is defined as meaning that, depending on the circumstances—and in particular the play between the spacing/wedging part 20 of the final packaging 2*a* and the side wall 5*b* of a wedging carton 4*a*—the side wall 5*b* of a wedging carton 4*a* is in contact with the corresponding stopping edge 21 with even—if necessary—a certain support force, in such a way as to ensure the locking of the wedging carton 4*a* in this position or else that the side wall 5*b* is only in the immediate proximity of this stopping edge 21—for example by a fraction of a millimeter or several millimeters—in such a way that the movement of the wedging carton 4*a* is limited to the small separation between the side wall 5*b* and the corresponding stopping edge 21, and that at the end of possible movement of the wedging carton 4*a*, the side wall 5*b* comes into contact with the stopping edge 21 in such a way as to ensure the locking of the wedging carton 4*a* in the final position of movement.

With the stopping edges 21 being suitable for stopping the wedging cartons 4*a*, as was just disclosed, they take part in that, in the pack 3, the wedging cartons 4*a* cannot move or can move only a little at an inopportune moment or strike one another. This is why the stopping edges 21 take part with the part 20 termed "spacing/wedging."

The shape, the arrangement, the dimensions of the constituent parts of the blank 1, of the intermediate packaging 2*a* and the final packaging 2, in particular the receiving part 18, the spacing/wedging part 20, and cutout lines 24 and 25, and the shape, the arrangement and the dimensions of the cartons 4 are in adaptation in such a way that in the final packaging 2, the side walls 5*b* of the wedging cartons 4*a* are adjacent to the stopping edges 21 as it was disclosed.

Taking into account that in the pack 3, the receiving part 18 and the longitudinally median transverse portion 22 of the base panel 13 of the spacing/wedging part 20 are separated from one another along the axis H, the empty spaces 33 of the blank 1 and the segments of cutout lines that limit them are deformed along the axis H, on the one hand, whereas, on the other hand, the segments of common or opposite cutout lines that limit the receiving part 18 and the spacing/wedging part are themselves also separated from one another along the axis H, creating or developing empty spaces 33*a* extending along the axis H.

Portions 35 of the side walls 5*b* of the wedging cartons 4*a* are placed in these empty spaces 33, 33*a*. For a given wedging carton 4*a*, such a portion 35 extends over an angle opening that can be on the order of 180° to 270°, for example, and over an axial height of the cartons of between the bottom 5*a* and the substantial part of the part of the side wall 5*b* that corresponds to the part of the stopping edge 21 comprising the cutout lateral segment 27 and an adjacent part of the cutout lateral extension 31.

According to the embodiments, the pack 3 comprises a single layer of cartons 4 or several layers of superposed cartons 4, whereas, as appropriate, a base carton layer consists of four wedging cartons 4*a* or else comprises these four wedging cartons 4*a*, and, from the side with an extension 40 or from each of the two sides with extensions 40, at least two additional cartons 4*c*, by extension of the four wedging cartons 4*a*.

The invention also relates to a production line of a pack 3 as it was just described.

Such a line comprises means for supplying flat cardboard blanks 1. It also comprises means for supplying cartons 4, designed to be part of the pack 3.

Such a line also comprises, combined with means for supplying flat cardboard blanks and with means for supplying cartons, conveying means, arranged horizontally overall, capable of conveying and designed to convey flat blanks, blanks with cartons resting above, intermediate packaging 2*a* and final packaging 2, with, longitudinally, functional means.

In the first place, from upstream to downstream, these functional means comprise means for gripping, moving and arranging wedging cartons 4*a*, capable of arranging and designed to arrange these cartons 4*a* on the receiving part 18 of the blanks 1 on the conveying means.

In the second place, these functional means comprise folding means, capable of expanding and designed to expand in volume the blanks 1 around the cartons 4 by folding connecting panels 12 around base grooved lines 15, side panels 11 around intermediate grooved lines 16, and top panels 10 around top grooved lines 17.

In the third place, these functional means comprise means for closing and connecting, capable of arranging and designed to arrange in a coplanar way and to connect two top panels 10*a*, 10*b* to one another, and to put together an intermediate packaging 2*a* surrounding the cartons 4.

In the fourth place, these functional means comprise stressing means that are capable of stressing and designed to stress the spacing/wedging part of cartons 20 in a relative way in relation to the rest of the intermediate packaging 2*a* and the wedging cartons 4*a*. These means are suitable for acting in a direction that is perpendicular or essentially perpendicular to the plane of movement of the conveying means, which corresponds to the axis H in such a way as to put together the final packaging 2 of the pack 3, and the pack 3 itself.

Such stressing means can comprise, primarily, holding means that are capable of holding and designed to hold the part of the intermediate packaging 2*a* other than the spacing/wedging part of the cartons 20. These means comprise, for example, holding belts, suction pads, guides, stops, and robots.

Next, such stressing means can comprise means for movement in the direction of the axis H, capable of acting and designed to act on the spacing/wedging part of cartons 20, in the direction of the divergence of the conveying means from the movement plane. These means comprise, for example, cylinders, movable plates, cams, suction pads, guides, and robots.

Finally, these functional means comprise means for removing the packs.

The invention claimed is:

1. Flat cardboard blank (1), of a general rectangular shape, designed for the formation of a final packaging (2) of a pack (3) of cartons (4), of the tubular envelope type, with the pack (3) including at least one base carton layer comprising four wedging cartons (4*a*) that are two by two, side by side, and opposite one another, positively spaced and wedged on their side walls (5*b*) in the vicinity of their bottom walls (5*a*), comprising:

Two top panels (10, 10*a*, 10*b*), two side panels (11, 11*a*, 11*b*), two connecting panels (12, 12*a*, 12*b*), a base panel (13), and a connecting means (14) for the closing on itself of the blank that is expanded in volume, Cutout lines, and grooved lines in the transverse direction, capable of folding and designed to fold panels, of expanding the blank in volume, and in putting together the packaging (2) and the pack (3), A receiving part (18), extending over a part (19*a*) of the base panel (13), for receiving wedging cartons (4*a*) by their bottom walls (5*a*), and if necessary extending over the connecting panels (12, 12*a*, 12*b*), And a spacing/wedging part (20), coming from the base panel (13) with cutout lines, able to be expanded in volume relative to the receiving part (18), in such a way as to put together stopping edges (21) of the wedging cartons (4*a*) on their side walls (5*b*) in the vicinity of their bottom walls (5*a*), characterized in that:

The continuous spacing/wedging part (20) is formed by a longitudinally median transverse portion (22) of the base panel (13) and a longitudinally median transverse portion (23), in two sections, of the two connecting panels (12, 12*a*, 12*b*), one section per connecting panel (12, 12*a*, 12*b*), A continuity approach exists between, on the one hand, the spacing/wedging part (20), and, on the other hand, the receiving part (18) and the portions (26) of connecting panels (12, 12*a*, 12*b*) other than the one of the spacing/wedging part (20), The segments of grooved lines (15*a*, 16*a*) of the spacing/wedging part (20) form two irreversible-pivot double hinges (15*a*, 15*b*), such that the longitudinally median transverse portion (22) of the base panel (13) can be separated from the receiving part (18) along an axis (H) that is perpendicular or essentially perpendicular to the receiving part (18), The spacing/wedging part (20) is limited in the transverse direction by two continuous and curved edge cutout lines of the spacing/wedging part (24), advancing overall in the longitudinal direction, whose segments form stopping edges (21).

2. Blank (1) according to claim 1, comprising:

Two free edges (8) in the longitudinal direction and two free edges (9) in the transverse direction, Arranged one behind another in the longitudinal direction, a first top panel (10, 10*a*, 10*b*), a first side panel (11, 11*a*, 11*b*), a first connecting panel (12, 12*a*, 12*b*), a base panel (13), a second connecting panel (12, 12*a*, 12*b*), a second side panel (11, 11*a*, 11*b*), and a second top panel (10, 10*a*, 10*b*), with a means (14) for connecting two top panels (10, 10*a*, 10*b*) to one another for the closing on itself of the blank expanded in volume with formation of a top wall (10*c*), Two base grooved lines (15), between the base panel (13) and the two connecting panels (12, 12*a*, 12*b*), two intermediate grooved lines (16), between the two connecting panels (12, 12*a*, 12*b*) and the two side panels (11, 11*a*, 11*b*), and two top grooved lines (17), between the two top panels (10, 10*a*, 10*b*) and the two adjacent side panels (11, 11*a*, 11*b*), The spacing/wedging part (20), limited in the longitudinal direction by, and extending between, two intermediate median grooved segments (16*a*) on either side of two base median grooved segments (15*a*), with, for each intermediate grooved line (16), a continuity approach between its median segment (16*a*) and its two end segments (16*b*), and, for each base grooved line (15), a continuity approach between its median segment (15*a*) and its two end segments (15*b*), with the intermediate median grooved segment (16*a*) and the base median grooved segment (15*a*) of a connecting panel (12, 12*a*, 12*b*) delimiting a section of the longitudinally median transverse portion (23) of the connecting panel (12, 12*a*, 12*b*) and forming one of the irreversible-pivot double hinges (15*a*, 16*a*) of this section of the longitudinally median transverse portion (23) of the connecting panel (12, 12*a*, 12*b*) relative to the longitudinally median transverse portion (22) of the base panel (13) and the side panels (11, 11*a*, 11*b*), For the base panel (13), a continuity approach between its longitudinally median transverse portion (23) and its two end portions (18*a*, 18*b*), and, for the two connecting panels (12, 12*a*, 12*b*), a continuity approach between the longitudinally median transverse portion (23) and the two end portions (26).

3. Blank (1) according to claim 2, wherein each edge cutout line of the spacing/wedging part (24) comprises two cutout lateral segments (27), and, between them, a cutout median segment (28), and wherein:

A cutout lateral segment (27) has a side end (29) on the intermediate grooved line (16) and a median end (30) toward the transverse median axis (T) of the base panel (13), extends with a convexity rotated toward the spacing/wedging part (20), and is capable of and designed for being part of a stopping edge (21), A cutout median segment (28) extends in the longitudinal direction.

4. Blank (1) according to claim 3, wherein a cutout lateral segment (27) extends over the adjacent connecting panel (12, 12*a*, 12*b*) and toward the adjacent end portion (26) of this connecting panel (12, 12*a*, 12*b*) by a cutout lateral extension (31) extending up to a side terminal end (32), over the adjacent base grooved line (15), in particular with a general shape that is close or similar to the one of a circular arc whose angle in the center is on the order of 90°.

5. Blank (1) according to claim 2, wherein the receiving part (18) is made of two separate carton receiving portions (18*a*, 18*b*), located on either side, transversely, of the longitudinally median transverse portion (22) of the base panel (13) of the spacing/wedging part (20).

6. Blank (1) according to claim 5, wherein a receiving portion (18*a*, 18*b*) of the receiving part (18) is limited opposite the spacing/wedging part (20), directly by a longitudinal free edge (8), with the blank (1) being especially suitable for and designed for a pack (3) whose base carton layer consists of four wedging cartons (4*a*).

7. Blank (1) according to claim 5, which, in the transverse direction, comprises, toward one and/or the other of its longitudinal free edges (8), an extension of the top panels (10, 10*a*, 10*b*), side panels (11, 11*a*, 11*b*), connecting panels (12, 12*a*, 12*b*), and base panel (13), and wherein one and/or the other of a receiving portion (18*a*, 18*b*) of the receiving part (18) is limited opposite the spacing/wedging part (20) indirectly via a longitudinal free edge (8), by means of the presence between them of the extension of the base panel (13) for receiving additional cartons (4*c*), with the blank (1) being especially suitable for and designed for a pack (3) whose base carton layer comprises the four wedging cartons (4*a*) and, from the side with an extension or from each of the two sides with extensions, at least two additional cartons (4*c*) arranged in the extension of four wedging cartons (4*a*).

8. Blank (1) according to claim 6, wherein a receiving portion (18*a*, 18*b*) of the receiving part (18) is limited toward the spacing/wedging part (20) by an edge cutout line of the continuous, curved receiving portion (25), advancing in the longitudinal direction, in such a way as to reach the two base grooved lines (15).

9. Blank (1) according to claim 8, wherein an edge cutout line of the receiving portion (25):

Has a side terminal end (32) on a base grooved line (15), essentially common with the side terminal end (32) of the adjacent cutout lateral extension (31), Is arranged opposite and separated by an empty space (33) of the adjacent cutout lateral extension (31) and a first length (27*a*) of the cutout lateral segment (27) that is adjacent to its side end (29), with the empty space (33) being capable of working and designed to work with the side wall (5*b*) of a wedging carton (4*a*), And is either common with a second length (27*b*) of the cutout lateral segment (27), which segment (27) consists of the first length (27*a*) and the second length (27*b*) end-to-end, and with the cutout median segment (28), or arranged opposite and separated by an empty space (33) of this second length and this cutout median segment (28).

10. Blank (1) according to claim 2, wherein the stopping edges (21), one per wedging carton (4*a*), comprise, except for cutout median segments (28), all or part of the edge cutout lines (24) of the spacing/wedging part (20) and their lateral extensions (31), in particular comprise substantially the entirety of the edge cutout lines (24) and their lateral extensions (31), and more particularly are formed by, in particular substantially consist of, the cutout lateral segments (27) and the cutout lateral extensions (31).

11. Blank (1) according to claim 2, wherein the longitudinally median transverse portion (22) of the base panel (13) of the spacing/wedging part (20) extends transversely over on the order of one-half the transverse dimension of the base panel (13) for a pack whose base carton layer consists of four wedging cartons (4*a*) or, respectively, on the order of one-third, for a pack whose base carton layer consists of at least six cartons including the four wedging cartons (4*a*) and two additional cartons (4*c*).

12. Blank (1) according to claim 1, wherein, in the longitudinal direction, each side panel (12, 12*a*, 12*b*) is made of a single portion or is made of several portions (38*a*, 38*b*) that are separated by folding lines or zones (39), with the blank (1) being suitable for and designed for a pack (3) having a single base carton layer, or having several carton layers—including the base layer and a top layer—in particular one side panel portion (12, 12*a*, 12*b*) per carton layer.

13. Process for the production of a pack (3) of cartons (4) including at least one base carton layer comprising four wedging cartons (4*a*), two by two, side by side and opposite one another, positively spaced and wedged on their side walls (5*b*) in the vicinity of their bottom walls (5*a*), each carton (4) being of the type that has a bottom wall (5*a*), a side wall (5*b*) closed on itself, and a top closure (6), packaged in a packaging (2) produced from a flat blank (1), expanded in volume and closed on itself, in which:

A flat cardboard blank (1), according to claim 1, is available,

Four wedging cartons (4*a*), designed to be part of the pack (3), are available, Four wedging cartons (4*a*) are arranged in a base carton layer on the receiving part (18) of the blank (1)—arranged horizontally overall—in such a way that the wedging cartons (4*a*) are arranged two by two, side by side and opposite one another, Then, the blank is expanded in volume, around cartons (4), by folding connecting panels (12, 12*a*, 12*b*) around the two base grooved lines (15), side panels (11, 11*a*, 11*b*) around two intermediate grooved lines (16), and top panels (10, 10*a*, 10*b*) around two top grooved lines (17), Then, in an intermediate stage, the two top panels (10, 10*a*, 10*b*) are arranged in a coplanar way, and they are connected to one another in such a way as to close on itself the blank that is expanded in volume, to form the top wall (10*c*), and to put together an intermediate packaging (2*a*) surrounding the cartons (4), in which the receiving part (18) and the longitudinally median transverse portion (22) of the base panel (13) of the spacing/wedging part (20) are essentially coplanar, Then, in a final stage, the spacing/wedging part (20) is stressed in a relative way in relation to the rest of the intermediate packaging (2*a*) and the cartons (4), in such a way that:

The longitudinally median transverse portion (22) of the base panel (13) of the spacing/wedging part (20) is separated in a relative way from the receiving part (18) and in a relative way is moved toward the top wall (10*c*), along the axis (H) of the packaging, whereas the two sections of the longitudinally median transverse portion (23) of the two connecting panels (12, 12*a*, 12*b*) are pivoted around irreversible-pivot double hinges (15*a*, 16*a*) in a relative way in relation to the end portions (26) of the two connecting panels (12, 12*a*, 12*b*) that are stationary, The stopping edges (21) are moved toward the side walls (5*b*) of the wedging cartons (4*a*) in such a way as to be positioned in an adjacent way to their side walls (5*b*), in the vicinity of their bottom walls (5*a*), And the final packaging (2) of the pack (3) as well as the pack (3) are thus put together.

14. Process according to claim 13, wherein to stress the spacing/wedging part (20), the longitudinally median transverse portion (22) of the base panel (13) is stressed directly and in particular at least toward the base median grooved segments (15*a*).

15. Process according to claim 13, wherein a section of the longitudinally median transverse portion (23) of a connecting panel (12, 12*a*, 12*b*) pivots around an intermediate median grooved segment (16*a*) by an angle on the order of 90°.

16. Process according to claim 13, wherein a section of the longitudinally median transverse portion (23) of a connecting panel (12, 12*a*, 12*b*) pivots around the intermediate median grooved segment (16*a*) by passing beyond a stressed intermediate position where it is located in the plane that is defined by the two intermediate grooved lines (16).

17. Intermediate packaging (2*a*), produced in the intermediate stage of the process according to claim 13, wherein:

The base panel (13) is arranged in a plane, with the receiving part (18) and the longitudinally median transverse portion (22) of the base panel (13) being essentially coplanar, The longitudinally median transverse portion (23) and the end portions (26) of a connecting panel (12, 12*a*, 12*b*) are essentially coplanar, and the connecting panels (12, 12*a*, 12*b*) are set up relative to the plane of the base panel (13) and form an oblique angle α with it, The side panels (11, 11*a*, 11*b*) extend beyond the connecting panels (12, 12*a*, 12*b*) up to the top wall (10*c*) and form an oblique angle β, close to the angle α, with the connecting panels (12, 12*a*, 12*b*).

18. Final packaging (2), produced in the final stage of the process according to claim 13, such that:

The receiving part (18) and the longitudinally median transverse portion (22) of the base panel (13) of the spacing/wedging part (20) are essentially parallel to one another and separated from one another, along the axis (H) of the packaging, and the longitudinally median transverse portion (22) of the base panel (13) is arranged between the plane of the receiving part (18) and the plane of the top wall (10*c*), The end portions (26) of the connecting panels (12, 12*a*, 12*b*) are set up relative to the receiving part (18) and form an oblique angle α with it, The section of the longitudinally median transverse portion (23) and the end portions (26) of each of the connecting panels (12, 12*a*, 12*b*) form an angle α with one another, The section of the longitudinally median transverse portion of each of the connecting panels (12, 12*a*, 12*b*) forms an acute angle θ with the adjacent side panel (11, 11*a*, 11*b*), The side panels (11, 11*a*, 11*b*) extend beyond the end portions (26) of the connecting panels (12, 12*a*, 12*b*) up to the top wall (10*c*) and form an oblique angle β, close to the angle α, with the end portions (26) of the connecting panels (12, 12*a*, 12*b*), The stopping edges (21), one per wedging carton (4*a*), comprise, except for cutout median segments (28), all or part of the edge cutout lines of the spacing/wedging part (20) and their lateral extensions, in particular substantially comprise all of the edge cutout lines and their lateral extensions, more particularly are formed by, in particular substantially consist of, the cutout lateral segments (27) and the cutout lateral extensions (31).

19. Final packaging (2) according to claim 18, wherein the angle α and the angle β are close and on the order of 135°, oblique, and the angle γ is on the order of a right angle.

20. Final packaging (2) according to claim 18, wherein the longitudinally median transverse portion (22) of the base panel (13) of the spacing/wedging part (20) is spaced from the receiving part (18) on the order of one-third of the distance between the longitudinally median transverse portion (22) of the base panel (13) of the spacing/wedging part (20), and the top wall (10*c*), for a pack (3) that has a single base carton layer or, respectively, on the order of one-fourth, for a pack (3) that has two carton layers—including the base layer and a top layer.

21. Final packaging (2) according to claim 18, wherein each side panel (12, 12*a*, 12*b*) is made of a single portion or is made of several portions (38*a*, 38*b*) that are separated by folding lines or zones (39), with the final packaging (2) being suitable for and designed for pack (3) that has a single base carton layer or that has several carton layers—including the base layer and a top layer—in particular one side panel portion (12, 12*a*, 12*b*) per carton layer (4).

22. Pack (3) of cartons (4), including at least one base carton layer comprising four wedging cartons (4*a*), two by two, side by side and opposite one another, positively spaced and wedged on their side walls (5*b*) in the vicinity of their bottom walls (5*a*), of the type having a bottom wall (5*a*), a side wall (5*b*) closed on itself, and a top closure (6), and a final packaging (2) according to claim 18, wherein:

The wedging cartons (4*a*) are received by their bottom walls (5*a*) on the receiving part (18), The top wall (10*c*) is applied on or adjacent to the closure of cartons being part of the pack (3), The stopping edges (21) of the packaging (2) are placed in an adjacent way to the side wall (5*b*) of the wedging cartons (4*a*) in the vicinity of their bottom walls (5*a*), in such a way as to ensure the spacing and the wedging of wedging cartons (4*a*) in the vicinity of their bottom walls (5*a*).

23. Pack (3) according to claim 22, wherein the cartons (4, 4*a*, 4*b*) comprise a collar (7), and the collars (7) of the cartons (4) of the top carton layer work with the cutout segments (34) of the top grooved lines (17).

24. Pack (3) according to claim 22, wherein portions of the side walls (5*b*) of the wedging cartons (4*a*) of the base carton layer are placed in empty spaces (33, 33*a*) between the receiving part (18) and the spacing/wedging part (20), extending along the axis (H) of the packaging.

25. Pack (3) according to claim 22, wherein the base carton layer consists of four wedging cartons (4*a*).

26. Pack (3) according to claim 22, wherein the base carton layer comprises the four wedging cartons (4*a*) and, from the side with an extension or from each of the two sides with extensions, at least two additional cartons (4*c*) arranged in extension of the four wedging cartons (4*a*).

27. Production line of a pack (3) of cartons (4) according to claim 22, which comprises:

Means for supplying flat cardboard blanks,

Means for supplying wedging cartons (4*a*), designed to be part of the pack (3), Combined with means for supplying flat cardboard blanks and with means for supplying wedging cartons (4*a*), conveying means, arranged horizontally overall, capable of conveying—and designed to convey—flat blanks, blanks with cartons (4) resting above, intermediate packaging (2*a*), final packaging (2), with, longitudinally, functional means comprising from upstream to downstream:

Means for gripping, moving and arranging cartons, capable of arranging and designed to arrange the four wedging cartons (4*a*) in a base layer, on the receiving part (18) of the blanks on the conveying means, Means for folding, capable of expanding and designed to expand in volume the blanks around cartons (4) by folding connecting panels (12, 12*a*, 12*b*) around the base grooved lines (15), side panels (11, 11*a*, 11*b*) around intermediate grooved lines (16), and top panels (10, 10*a*, 10*b*) around top grooved lines (17), Means for closing and for connecting, capable of arranging and designed to arrange in a coplanar way and to connect the two top panels (10, 10*a*, 10*b*) to one another, and to put together an intermediate packaging (2*a*) that surrounds the cartons (4), Stressing means, capable of stressing and designed to stress the spacing/wedging part (20) in a relative way in relation to the rest of the intermediate packaging (2*a*) and to four wedging cartons (4*a*), suitable for acting in a direction that is perpendicular or essentially perpendicular to the plane of movement of the conveying means, which is also the axis (H) of the packaging, in such a way as to put together the final packaging (2) of the pack (3), and the pack (3), And means for removing the packs (3).

* * * * *